US006630625B1

(12) United States Patent
Akashi et al.

(10) Patent No.: US 6,630,625 B1
(45) **Date of Patent: *Oct. 7, 2003**

(54) WIRE HARNESS AND METHOD OF MANUFACTURING THE SAME

(75) Inventors: Kazuya Akashi, Tomisato-machi (JP); Kazuo Enomoto, Urawa (JP); Naoki Goshima, Tokyo (JP); Kenichirou Takahashi, Sakura (JP); Hideki Kawamura, Tokyo (JP); Takeshi Hasegawa, Kuroiso (JP); Yasuo Takemura, Tokyo (JP); Hidetaka Yamazaki, Tokyo (JP); Atsushi Hamada, Tokyo (JP)

(73) Assignee: Fujikura Limited, Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/412,118

(22) Filed: Mar. 28, 1995

(30) Foreign Application Priority Data

Mar. 29, 1994 (JP) ..... 6-083925

(51) Int. Cl.[7] ..... H01B 5/14

(52) U.S. Cl. ..... 174/72 A; 174/71 R; 174/72 C; 174/72 TR

(58) Field of Search ..... 174/72 A, 71 R, 174/72 R, 72 C, 72 TR, 117 F, 117 FF

(56) References Cited

U.S. PATENT DOCUMENTS

| | | | | |
|---|---|---|---|---|
| 3,627,903 A | * | 12/1971 | Plummer | 174/72 A |
| 3,733,428 A | * | 5/1973 | Fry | 174/72 A |
| 3,819,848 A | * | 6/1974 | Fry | 174/117 F |
| 3,836,415 A | * | 9/1974 | Hilderbrandt | 174/72 A X |
| 4,065,199 A | * | 12/1977 | Andre et al. | 174/72 A X |
| 4,907,836 A | | 3/1990 | Ueda et al. | 174/72 A X |
| 5,092,647 A | | 3/1992 | Ueda et al. | 174/65 R X |
| 5,281,765 A | | 1/1994 | Iura et al. | 174/117 F |

FOREIGN PATENT DOCUMENTS

| | | |
|---|---|---|
| EP | 0242113 | 10/1987 |
| EP | 0534659 A2 | 3/1993 |
| EP | 0570893 A1 | 11/1993 |
| GB | 2141593 A | 12/1984 |
| JP | 3-274610 | 12/1991 |
| JP | 4-43511 | 2/1992 |
| JP | 4-82114 | 3/1992 |
| JP | 4-342907 | 11/1992 |

OTHER PUBLICATIONS

Office Action from Chinese Patent Office, dated Aug. 3, 2001, and English translation thereof.

* cited by examiner

*Primary Examiner*—Albert W. Paladini
(74) *Attorney, Agent, or Firm*—Finnegan, Henderson, Farabow, Garrett & Dunner, L.L.P.

(57) ABSTRACT

A wire harness includes a flat cable having a trunk portion formed by covering a plurality of parallel electric wires with an insulating coating by integral molding, a plurality of branch portions formed by branching the trunk portion, and a joint device for connecting not less than two electric wires of the plurality of electric wires constituting the trunk portion to electrically short-circuit the branch portions. A wire harness manufacturing method includes the step of tearing an end portion of a trunk portion of a flat cable in accordance with the number of branch portions required, and cutting off unnecessary portions, thereby forming branch portions, the trunk portion being formed by covering a plurality of electric wires with an insulating coating by integral molding, the step of mounting a connector on the distal end of each branch portion, and the step of mounting a joint device on the trunk portion to electrically short-circuit not less than two electric wires of the electric wires of the trunk portion.

18 Claims, 15 Drawing Sheets

WIRE HARNESS AND METHOD OF MANUFACTURING THE SAME

BACKGROUND OF THE INVENTION

1. Field of the Invention

The present invention relates to a wire harness and a method of manufacturing the same.

2. Description of the Related Art

For example, a wire harness generally used for a vehicle or the like is constituted by a bundle of a plurality of electric wires which branch off at proper positions to connect a plurality of electric devices with each other.

Since such a wire harness has a substantially circular cross-section, it is difficult to decrease the thickness of the wire harness. When, for example, a wire harness is to be installed in a door of a vehicle, the wire harness must be arranged to avoid the space for window members housed in the door. For this reason, the wire harness must be installed over a long distance.

In addition, when a large number of electric wires are to be installed, a branching operation is difficult to perform. If the electric wires are to be distinguished from each other by using different colors in consideration of such a situation, a large number of colors are required, resulting in an increase in cost.

SUMMARY OF THE INVENTION

It is an object of the present invention to provide a wire harness and a method of manufacturing the same, which suppress an increase in thickness of the wire harness and allows it to be installed in a narrow space.

It is another object of the present invention to provide a wire harness and a method of manufacturing the same, which allow an easy branching operation regardless of the number of electric wires.

According to the present invention, there is provided a wire harness comprising a flat cable having a trunk portion formed by covering a plurality of parallel electric wires with an insulating coating by integral molding, a plurality of branch portions formed by branching the trunk portion, and a joint device for connecting not less than two electric wires of the plurality of electric wires constituting the trunk portion to electrically short-circuit the branch portions.

In addition, according to the present invention, there is provided a wire harness manufacturing method, comprising the step of mounting a connector to end portions of electric wires of a trunk portion which include electric wires to be short-circuited between branch portions, which are arranged to be adjacent to each other, and which are equal to a number obtained by subtracting the number of short-circuited electric wires from the total number of electric wires of the trunk portion, the step of mounting a joint device, the step of electrically short-circuiting not less than two electric wires by using a short-circuiting member, the step of cutting an electric wire to be short-circuited between a position where the short-circuiting metal member is mounted and the connector of an end portion of the trunk portion, and the step of electrically short-circuiting an electric wire arranged between a cutting position and the connector and an electric wire which is arranged at an end portion, of the trunk portion, in a direction of width thereof, and is not connected to the connector.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

BRIEF DESCRIPTION OF THE DRAWINGS

The accompanying drawings, which are incorporated in and constitute a part of the specification, illustrate presently preferred embodiments of the invention and, together with the general description given above and the detailed description of the preferred embodiments given below, serve to explain the principles of the invention.

DETAILED DESCRIPTION OF THE PREFERRED EMBODIMENTS

Figure 1:
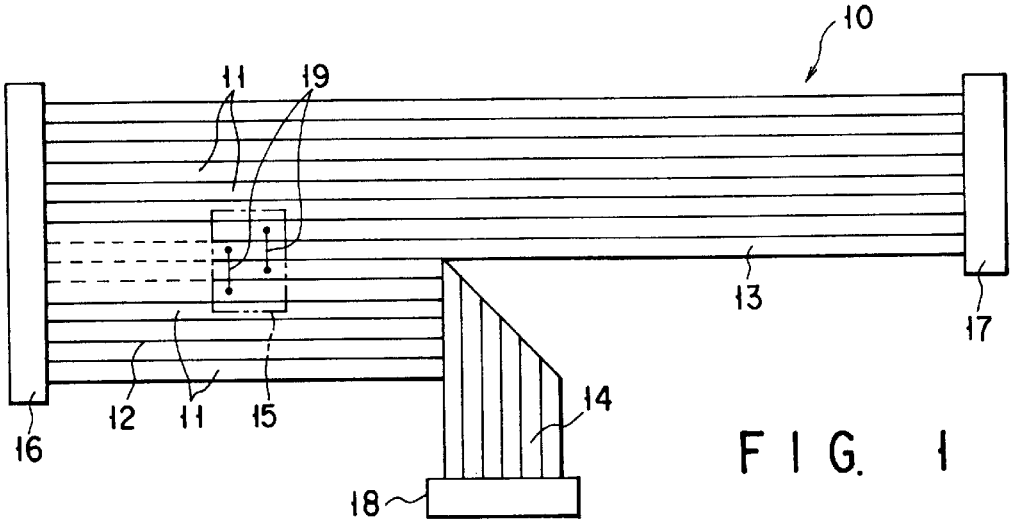
FIG. 1 is a plan view showing a wire harness according to the first embodiment of the present invention.

Embodiments of the present invention will be described below. The first embodiment of the present invention will be described first with reference to FIG. 1. Referring to FIG. 1, reference numeral 10 denotes a wire harness of this embodiment. The wire harness 10 comprises a trunk portion 12 constituted by a flat cable formed by covering a plurality of parallel electric wires 11 with an insulating coating by integral molding, branch portions 13 and 14 formed by branching one end portion of the trunk portion 12, and a joint device 15 arranged on the trunk portion 12 to connect two or more electric wires of the electric wires 11 constituting the trunk portion 12 so as to electrically short-circuit the branch portions 13 and 14.

A first connector 16 is mounted on an end portion, of the trunk portion 12, located on the opposite side to the branch portions 13 and 14 of the electric wires 11. Second and third connectors 17 and 18 are respectively mounted on the end portions of the branch portions 13 and 14.

The joint device 15 connects two pairs of different electric wires 11 corresponding to the branch portions 13 and 14.to each other via two short-circuiting metal members 19.

As indicated by the broken lines in FIG. 1, the electric wires short-circuited by the short-circuiting metal members 19 are used to electrically connect the branch portions 13 and 14 to each other, and hence are cut in advance so as not to be connected to the first connector 16.

According to the wire harness 10, the trunk portion 12 and the branch portions 13 and 14 can be formed from one flat cable. Therefore, in the step of cutting the flat cable and the step of mounting the connectors, the electric wires 11 can be easily positioned with respect to the connectors 16, 17, and 18, resulting in an improvement in manufacturing efficiency. In addition, the cutting step, the connector mounting step, and the like can be easily automated.

Figure 2:
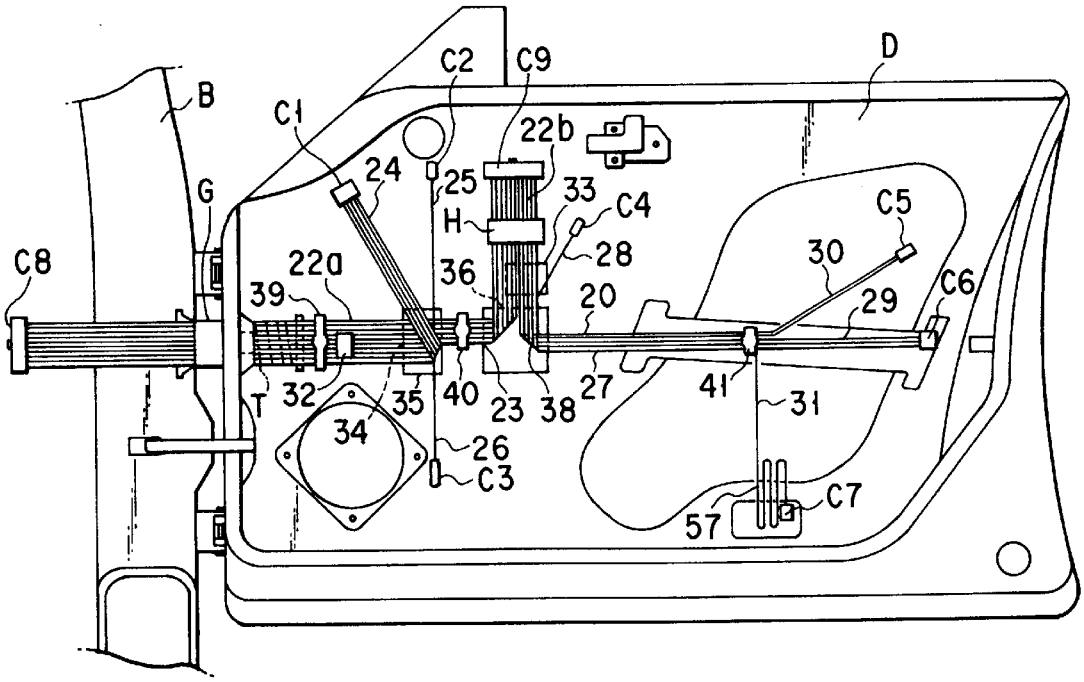
FIG. 2 is a plan view of a wire harness according to the second embodiment of the present invention.

A wire harness according to the second embodiment of the present invention will be described next with reference to FIGS. 2 to 6. Referring to FIG. 2, reference numeral 20 denotes a wire harness. The wire harness 20 is installed to spread all over the interior of a door D. In addition, one end of the wire harness 20 is arranged in a body B of a vehicle.

Figure 3:
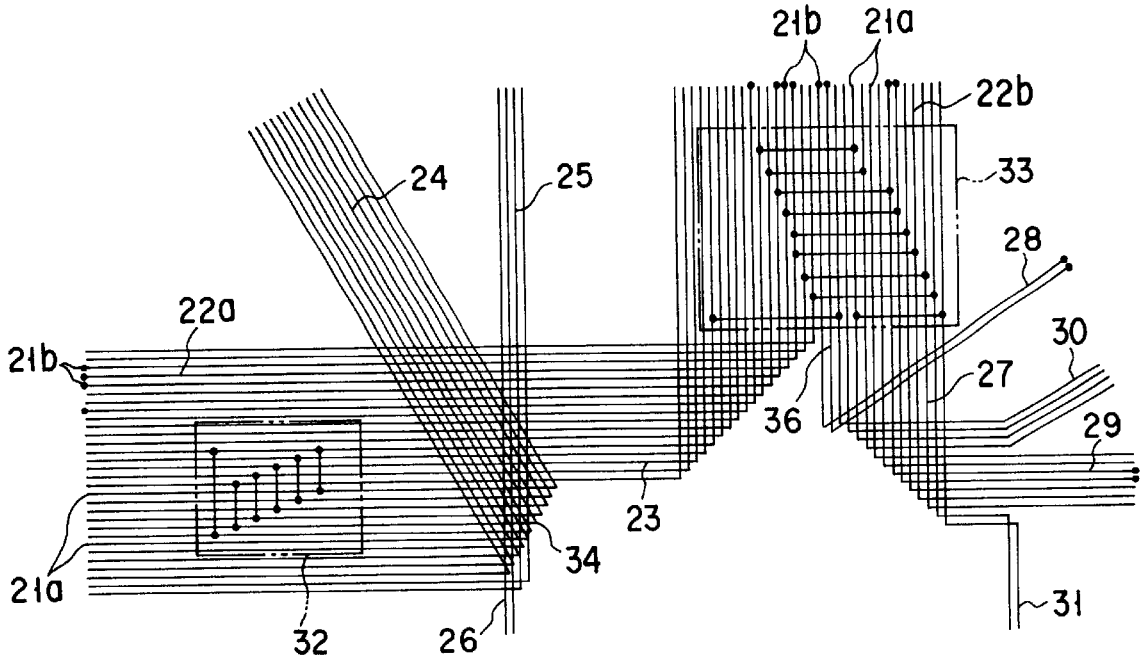
FIG. 3 is a plan view showing the internal connection of the wire harness in FIG. 2.

As shown in FIGS. 2 and 3, similar to the wire harness 10 in FIG. 1, the wire harness 20 comprises first and second trunk portions 22*a* and 22*b* constituted by a flat cable formed by integrating a plurality of electric wires 21 into a parallel strip using an insulating coating, first to ninth branch portions 23, 24, 25, 26, 27, 28, 29, 30, and 31 formed by branching one end portion of each of the first and second trunk portions 22*a* and 22*b*, a first joint device 32 arranged on the first trunk portion 22*a* to connect two or more electric wires of the electric wires 21 constituting the first trunk portion 22*a* so as to electrically short-circuit the branch portions 23 and 24, and a second joint device 33 arranged on the second trunk portion 22*b* to connect a plurality of electric wires 21 constituting the second trunk portion 22*b* so as to electrically short-circuit the branch portions 23 and 27.

Figure 4:
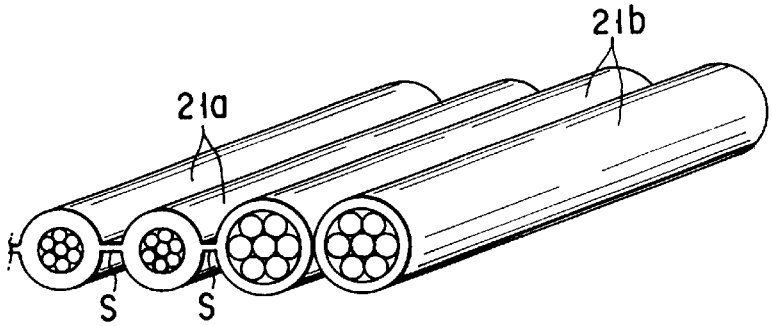
FIG. 4 is a perspective view showing a flat cable constituting the wire harness in FIG. 2.

As shown in FIG. 4, each of the first and second trunk portions 22*a* and 22*b* is formed by integrating large numbers of electric wires 21*a* and 21*b* having different diameters into a parallel strip using an insulating coating S. The electric wires 21*a* and 21*b* are coupled to each other at an equal array pitch by adjusting the widths of coupling portions S consisting of an insulating coating material and arranged among the electric wires 21*a* and 21*b*. Each of the first and second trunk portions 22*a* and 22*b* is formed by covering the conductor portion of each electric wire 21 with a resin member formed by extrusion molding as an insulating coating. Referring to FIG. 3, each electric wire 21 having a dot attached to its distal end is a large-diameter electric wire 21*b*, and each electric wire 21 having no dot is a small-diameter electric wire 21*a*. Each branch portion has the same structure as that shown in FIG. 4.

Note that the conductor portion of each of the electric wires 21*a* and 21*b* is a multicore stranded wire.

As shown in FIG. 2, the first to ninth branch portions 23, 24, 25, 26, 27, 28, 29, 30, and 31 spread inside the door D. The end portions of these branch portions except for the first and fifth branch portions 23 and 27 are respectively connected to electric devices (not shown) arranged in the door D via first to seventh connectors C1, C2, C3, C4, C5, C6, and C7. The end portion of the first trunk portion 22*a* is connected to a wire harness (not shown) in the body B via an eighth connector C8. The end portion of the second trunk portion 22*b* is connected to an electric device (a speaker for audio, a motor for powered window, etc.) in the door D via a ninth connector C9.

As shown in FIG. 2, a grommet G is fitted on the first trunk portion 22*a*, of the wire harness 20, located between the body B and the door D so that the first trunk portion 22*a* can be freely bent. A tape T is wound around a portion, of the first trunk portion 22*a*, located near the grommet G to fix the first trunk portion 22*a* to the grommet G.

As shown in FIGS. 2 and 3, all the first to fourth branch portions 23, 24, 25, and 26 branch off at a first branching portion 34, and the respective branch angles are fixed and held by a first adhesive tape 35 stuck on the first branching portion 34.

Similarly, all the first, fifth, and sixth branch portions 23, 27, and 28 branch off at a second branching portion 36 of the second trunk portion 22*b*, and the respective branch angles are fixed and held altogether by a second adhesive tape 38 stuck on the second branching portion 36.

The first trunk portion 22*a* and the first and fifth branch portions 23 and 27 have first to third clips 39, 40, and 41 (to be described later), respectively, to be attached to the door D via the clips 39, 40, and 41.

The portion between the joint device 32 of the first and second branch portions 23 and 24 and the eighth connector C8 can be cut off.

Figure 5:
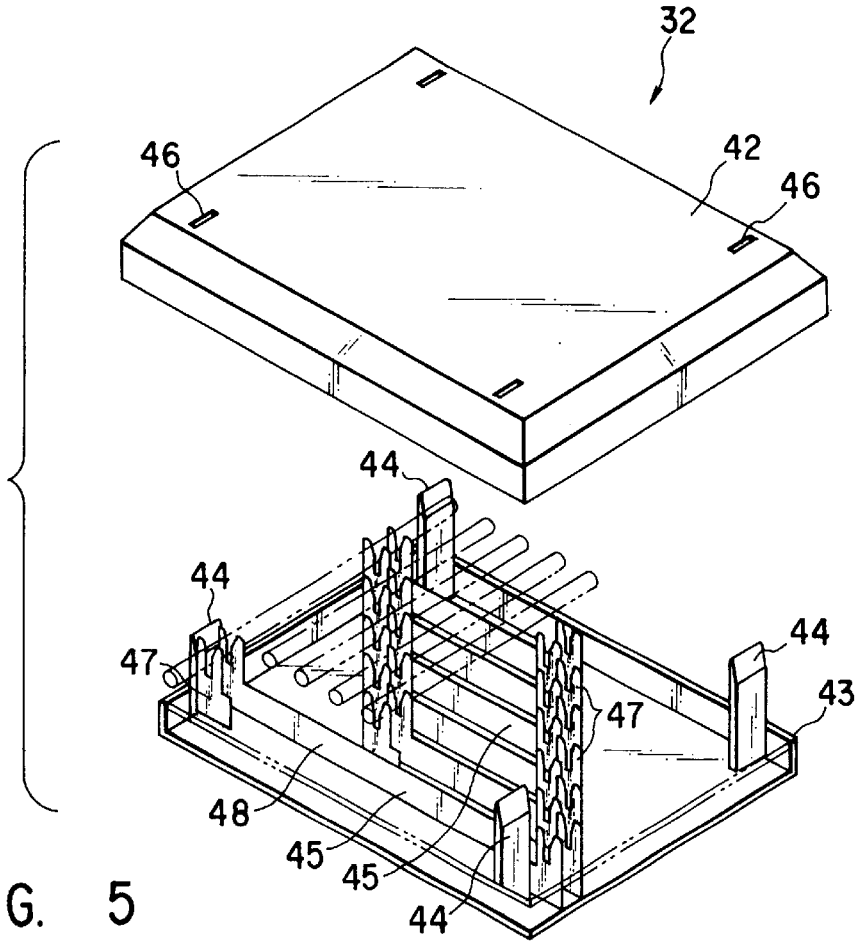
FIG. 5 is an exploded perspective view showing the arrangement of a joint device.

As shown in FIG. 5, the first joint device 32 comprises upper and lower halves 42 and 43 which are respectively brought into contact with the upper and lower surfaces of the first trunk portion 22*a*, an engaging/holding means for engaging/holding the upper and lower halves 42 and 43 in contact with the upper and lower surfaces of the first trunk portion 22*a*, and a plurality of short-circuiting metal members 45 arranged on the lower half 43 to short-circuit pairs of electric wires 21 constituting the first trunk portion 22*a*.

The upper and lower halves 42 and 43 are formed by cutting a flat, box-like plastic member consisting of nylon or the like into halves at a middle position in the direction of thickness. Therefore, when the upper and lower halves 42 and 43 are stacked on each other with their opening portions opposing each other, a closed box-like shape is formed.

The engaging/holding means are resin projections 44 arranged at the four corners of the lower half 43 to extend outside the lower half 43. When the lower and upper halves 43 and 42 are stacked on each other, the projections 44 extend through through holes 46 formed in the upper half 42 such that the distal ends of the projections 44 extend outside the upper half 42 via the through holes 46. By fusing/deforming the distal ends extending from the upper half 42, the projections 44 are fusion-bonded to the upper half 42. That is, the upper and lower halves 42 and 43 can be engaged/held in a stacked state. In addition, each engaging/holding means 44 is long enough to hold a stacked state of the upper and lower halves 42 and 43 with the first trunk portion 22*a* being clamped therebetween.

As shown in FIG. 5, each short-circuiting metal member 45 comprises at least a pair of terminal portions 47 which bite into the insulating coating of the electric wires 21 to contact them, and a coupling portion 48 for electrically coupling the terminal portions 47 to each other. The short-circuiting metal member 45 is a plate-like member having the terminal portions 47 and the coupling portion 48 formed from one conductive metal plate. These short-circuiting metal members 45 are successively arranged on the lower half 43 to overlap along the axis of the first trunk portion 22*a*.

Although not described with reference to the accompanying drawings, the second joint device 33 has the same arrangement as that of the first joint device 32 and is larger in size than the first joint device 32.

Figure 6A:
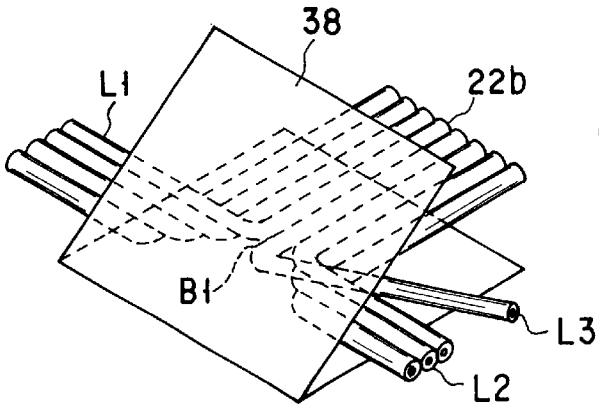
FIG. 6A is a perspective view showing a method of clamping a trunk portion by using first and second adhesive tapes.
Figure 6B:
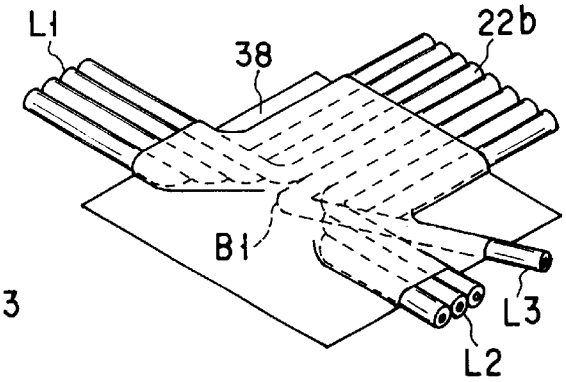
FIG. 6B is a perspective view showing a method of fixing each cable by using the first and second adhesive tapes.

FIGS. 6A and 6B are perspective views showing a detailed example of how the second adhesive tape 38 is used. As shown in FIGS. 6A and 6B, when the branch angles of branch portions L1, L2, and L3 with respect to the trunk portion 22 are large, the branch portions L1, L2, and L3 are bent near a branching portion B1, and the adhesive tape 38 is stuck on the branching portion B1 while it is sandwiched between two parts of the folded adhesive tape 38 from the upper and lower surfaces sides of the branching portion B1. The adhesive tape 38 is tightly stuck on the cables 22, L1, L2, and L3, which constitute the branching portion, along their outer surfaces, thereby fixing the cables 22, L1, L2, and L3.

The first clip 39 mounted on the first trunk portion 22*a* has a pair of upper and lower casings for clamping the first trunk portion 22*a* from the upper and lower surface sides. The lower casing has lock portions for mounting the clip 39 on the door D at a predetermined position.

The upper and lower casings are elongated members which are slightly larger in width than the first trunk portion 22*a*. Clamp projections are formed on two edge portions of the upper casing in the direction of width and a central portion of the lower casing in the direction of width to extend toward the opposing casings. These clamp projections serve to clamp the first trunk portion 22*a* when the upper and lower casings are stacked on each other. In addition, one end of the upper casing and one end of the lower casing in the longitudinal direction are pivotally coupled to each other via a pivot portion such that the upper and lower casings can be brought close to each other and separated from each other while the clamp projections oppose each other. In addition, an engaging projection and an engaging recess are formed on end portions, of the upper and lower casings, located on the opposite side to this pivot portion to oppose each other. When the upper and lower casings are stacked on each other, the engaging projection and the engaging recess are engaged with each other, thereby holding the stacked state of the upper and lower casings.

A clip Cp having a function of fixing/holding a branch portion is used to fix/hold a branch portion at a branching portion and lock a branch portion to the door D.

A portion of a cable is bent in the direction of thickness and formed into bellows. For example, such a portion is formed on the fifth branch portion 27 to absorb variations in dimension in the manufacturing process so as to prevent the wire harness 20 from interfering with window members (not shown) housed in the door D.

In addition, as shown in FIG. 2, a mark H indicating the inspection result, type, and the like of the wire harness 20 is mounted on the second trunk portion 22*b* at a position between the ninth connector C9 and the second joint device 33. A stable mounting means for the second trunk portion 22*b* can also be attached to this mark H, similar to the first to third clips 39, 40, and 41.

Figure 16:
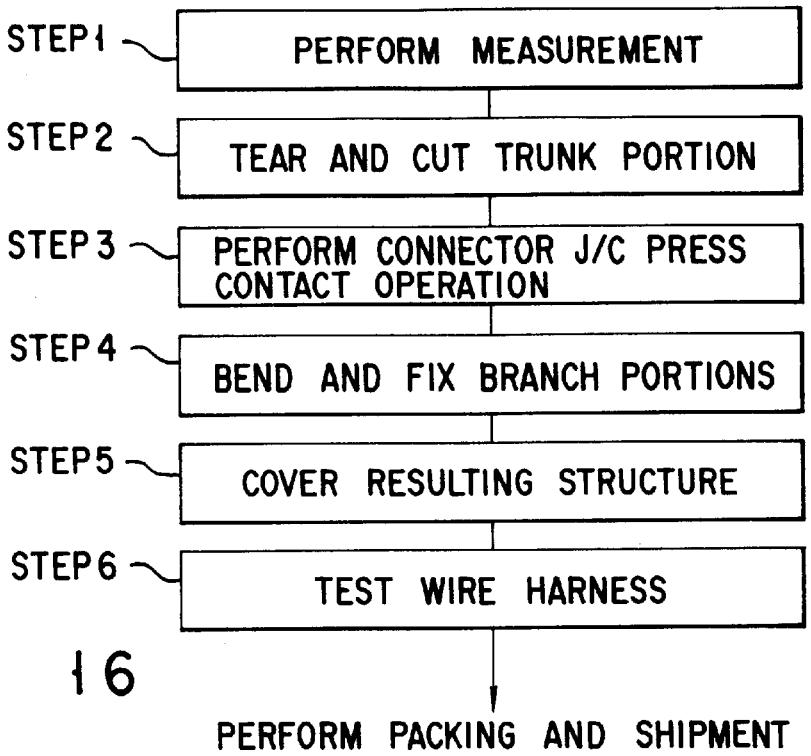
FIG. 16 is a flow chart showing a method of manufacturing a wire harness of the present invention.

A method of manufacturing a wire harness will be described next with reference to FIGS. 7 to 14 and 16. FIGS. 7 to 12 are plan views showing a method of manufacturing the wire harness 20. FIG. 16 is a flow chart showing the steps in this manufacturing method. This manufacturing method will be briefly described with reference to FIGS. 7 to 12, and will be described in detail with reference to FIGS. 13 and 14.

Figure 7:
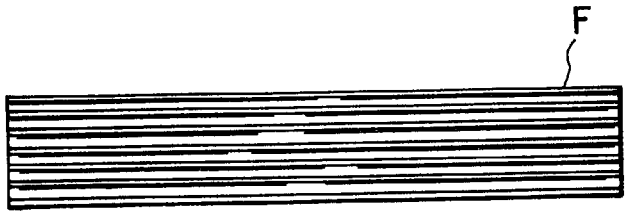
FIG. 7 is a plan view showing a step in a method of manufacturing a wire harness of the present invention.
Figure 8:
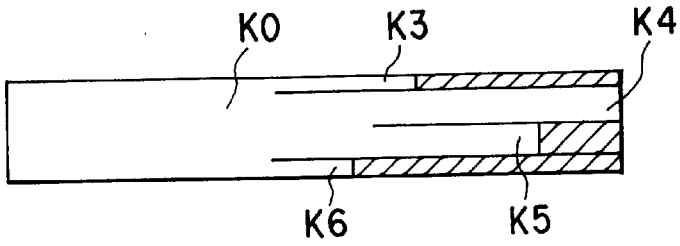
FIG. 8 is a plan view showing a step in a method of manufacturing the wire harness of the present invention.
Figure 13:
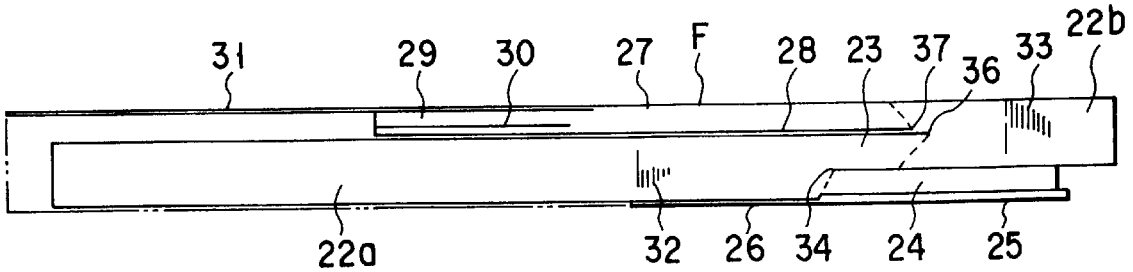
FIG. 13 is a plan view showing the step in FIG. 8, in detail, in the method of manufacturing the wire harness in FIG. 2.

As shown in FIGS. 7 and 8, the length of a flat cable F measured (step 1) and the end portion of a trunk portion K0 constituted by a flat cable F formed by integrating the plurality of electric wires 21 into a parallel strip using the insulating coating S is torn in accordance with the number of branch portions required, and unnecessary portions are cut off (step 2), thereby forming first to fourth branch portions K3, K4, K5, and K6. For example, FIG. 13 shows branch portions formed from the flat cable F corresponding to the wire harness 20 shown in FIG. 2.

Figure 9:
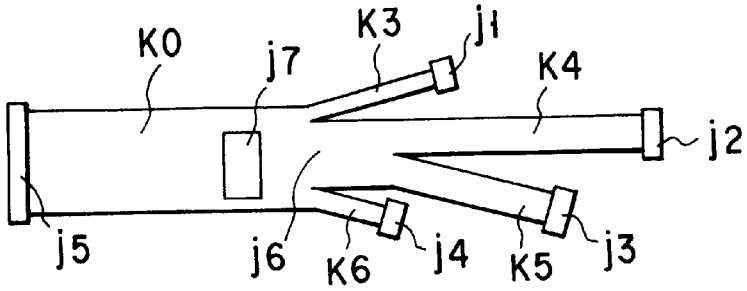
FIG. 9 is a plan view showing a step in a method of manufacturing the wire harness of the present invention.

Subsequently, as shown in FIG. 9, first to fourth connectors j1, j2, j3, and j4 are respectively connected to the distal ends of the first to fourth branch portions K3, K4, K5, and K6, and a fifth connector j5 is connected to the end portion of the trunk portion K0 (step 3). In addition, a first joint device j7 is arranged near a branching portion j6 of the first to fourth branch portions K3, K4, K5, and K6 of the trunk portion K0. The first to fourth branch portions K3, K4, K5, and K6 whose branch angles are large are bent (step 4).

Figure 14:
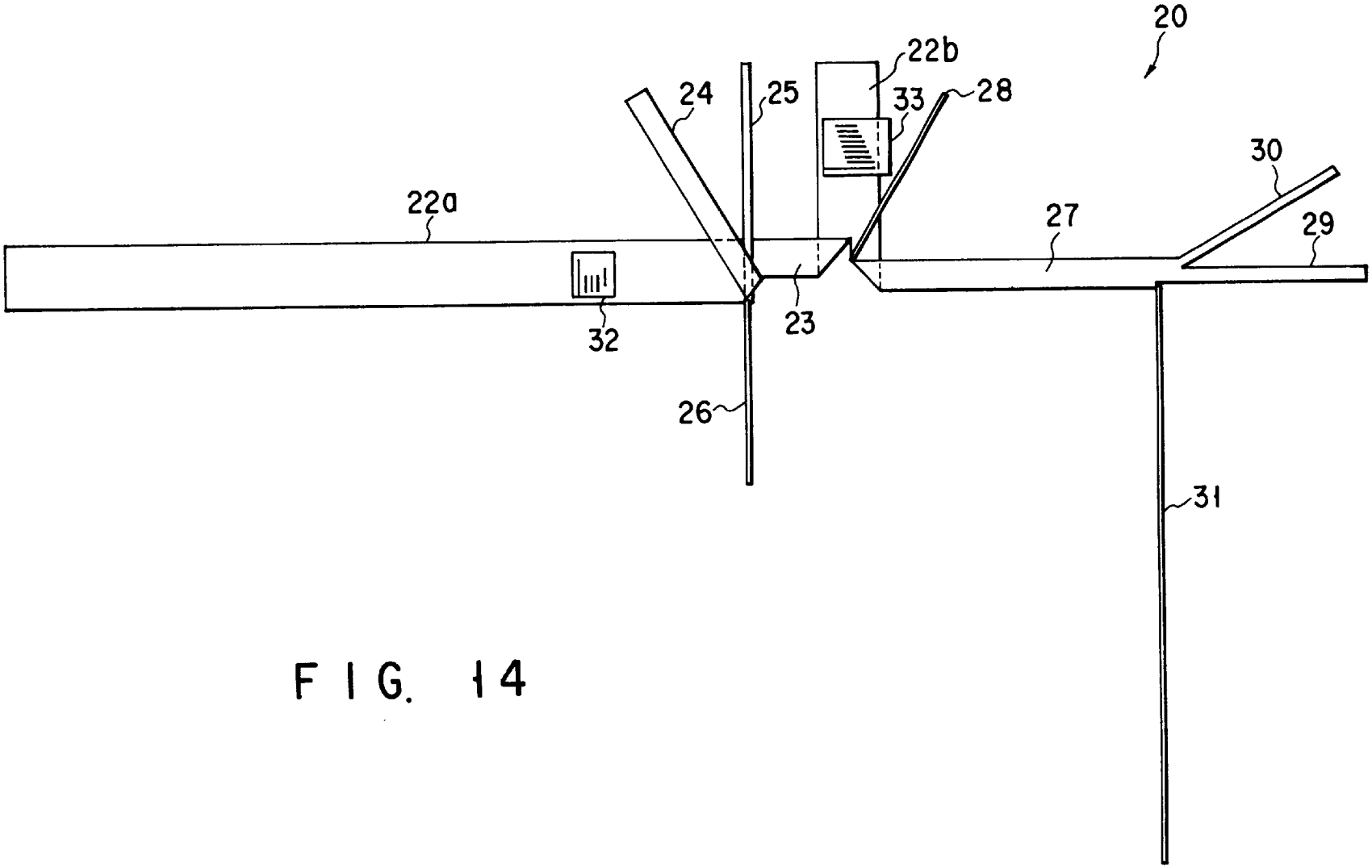
FIG. 14 is a plan view showing the step in FIG. 10, in detail, in the method of manufacturing the wire harness in FIG. 2.

For example, FIG. 14 shows how the first to ninth branch portions 23, 24, 25, 26, 27, 28, 29, 30, and 31 corresponding to the wire harness 20 are bent.

Figure 10:
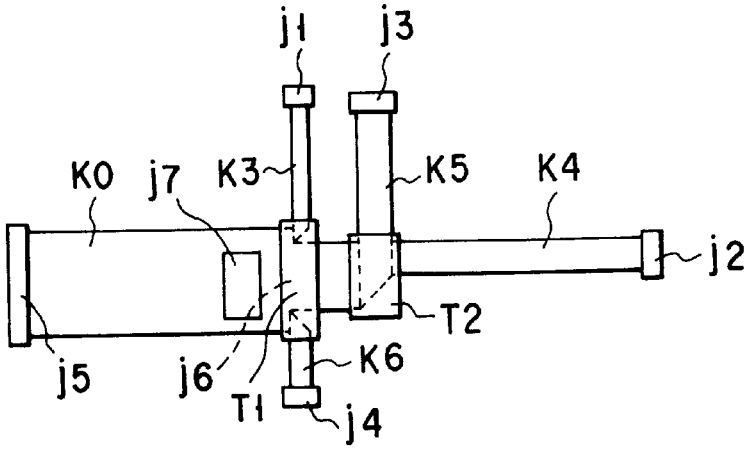
FIG. 10 is a plan view showing a step in a method of manufacturing the wire harness of the present invention.

As shown in FIG. 10, the bent portions of the first, third, and fourth branch portions K3, K5, and K6 are fixed with first and second adhesive tapes T1 and T2.

Figure 11:
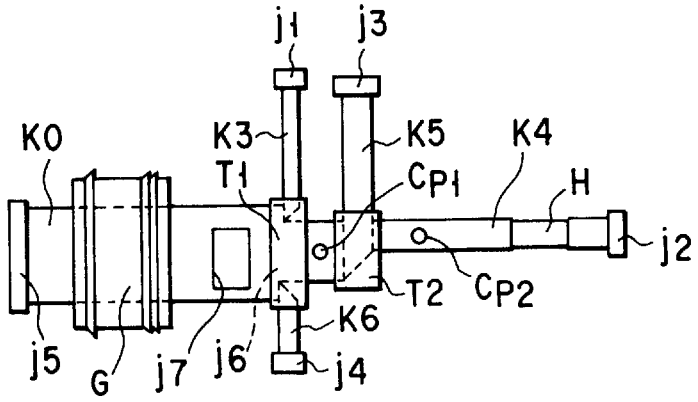
FIG. 11 is a plan view showing a step in a method of manufacturing the wire harness of the present invention.

As shown in FIG. 11, when fixing of the bent portions is completed, the grommet G is mounted on the bent portion of the trunk portion K0. A portion near the branching portion j6 and the second branch portion K4 are fixed with first and second clips Cp1 and Cp2.

Figure 12:
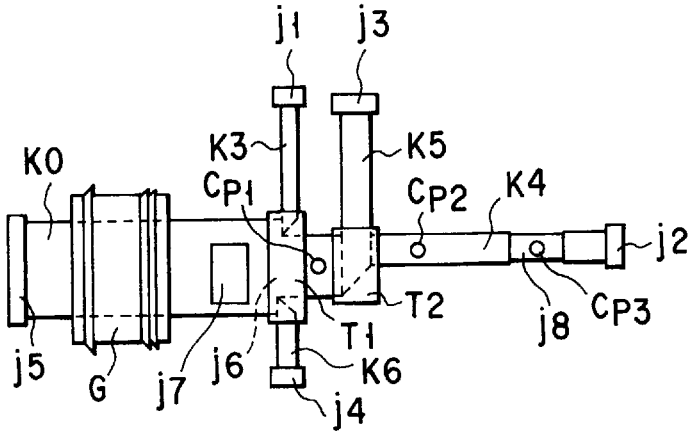
FIG. 12 is a plan view showing a step in a method of manufacturing the wire harness of the present invention.

As shown in FIG. 12, a proper portion is fixed with a clip Cp (e.g., a clip Cp3).

Thereafter, the wire harness 20 is received (step 5) in cover and tested (step 6).

With this arrangement of the wire harness 20, a multicore circuit can be made of a single flat cable F by using the first and second joint devices 32 and 33. Therefore, an increase in the thickness of the circuit can be suppressed. In addition, even if the number of electric wires 21 integrated into a flat cable is large, the branching step, the connector mounting step, and the like are easy to perform. Because the wire harness 20 is made of a single flat cable F, the installation of the wire harness can be easily performed.

Since the first and second branch portions 34 and 36 of the wire harness 20 are fixed with the adhesive tapes 35 and 38, tearing and the like of the insulating coating S of the branch portions 34 and 36 which are caused by external forces can be prevented, and damage to each branch portion after installation can also be prevented. This facilitates installation of the wire harness in a place at which it is exposed to vibrations.

In addition, since the first to third clips 39, 40, and 41 are mounted on the wire harness 20, damage to the wire harness, displacement thereof, and the like caused by external forces such as vibrations can be prevented as a whole. This allows stable installation of a multicore harness in a place where it is subject to the influence of external forces.

Since the fifth branch portion 31 has an extendible portion 57, the branch portion can be easily installed in the door D. In addition, the wire harness is formed from a single flat cable F and hence has uniform strength. This makes the wire harness 20 have antivibration and anti-deformation effects. Therefore, the number of extendible portions 57 and clips 39, 40, and 41 to be installed can be decreased, and a reduction in manufacturing cost and an improvement in manufacturing efficiency can be achieved.

According to the method of manufacturing the wire harness 20, since a single flat cable is processed, positioning in the cutting step, the connector mounting step, and the like is facilitated. Therefore, the manufacturing efficiency can be improved, and each manufacturing step can be easily automated.

Figure 15:
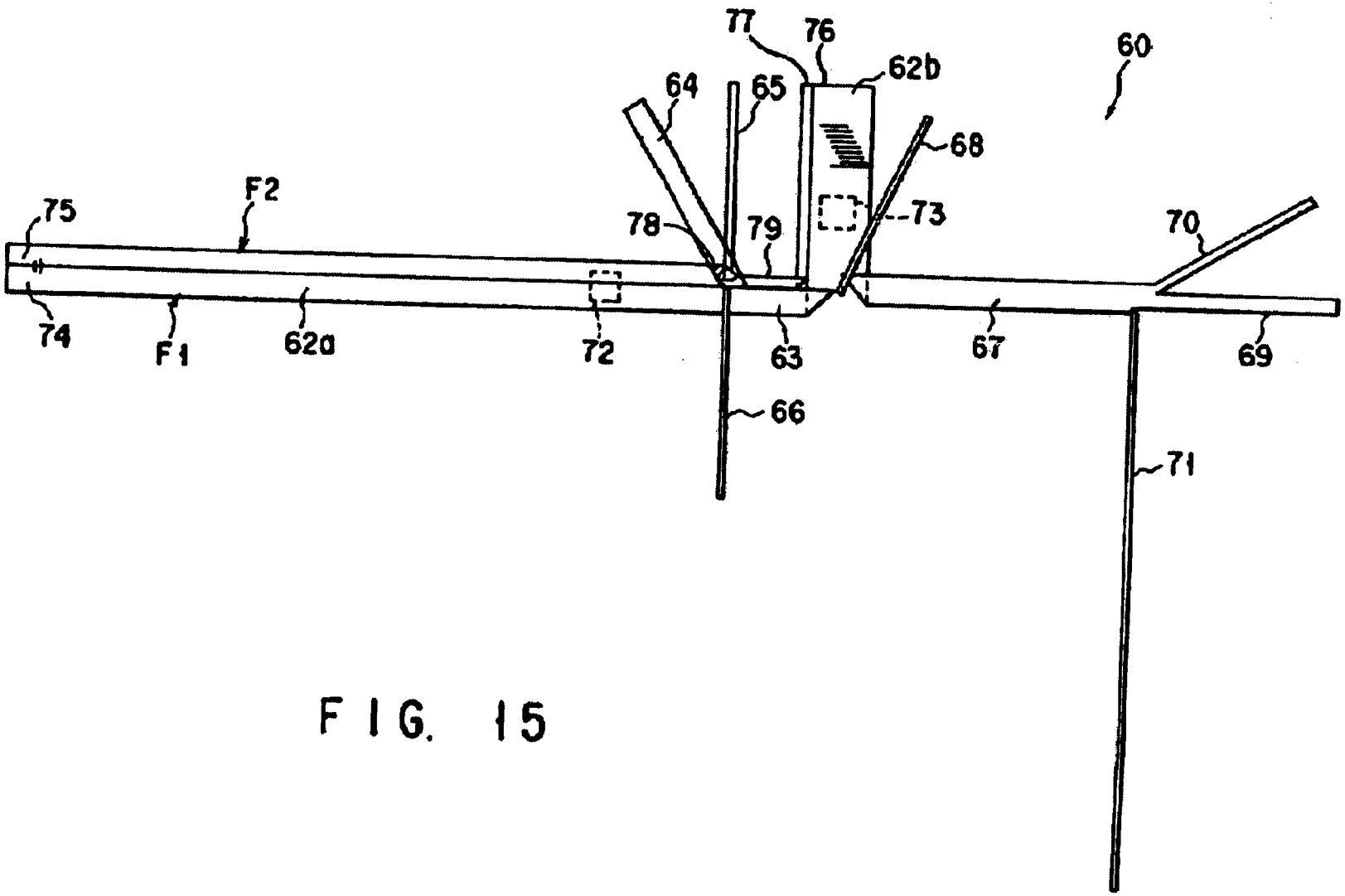
FIG. 15 is a plan view showing a wire harness according to the third embodiment of the present invention.

The third embodiment of the present invention will be described next with reference to FIG. 15. Referring to FIG. 15, reference numeral 60 denotes a wire harness. In this wire harness 60, the first, second, and third branch portions 24, 25, and 26 of the wire harness 20 shown in FIGS. 2 and 4 are formed from another flat cable F2.

The wire harness 60 is substantially constituted by first and second flat cables F1 and F2, each formed by integrating a plurality of electric wires as shown in FIG. 4 into a parallel strip using an insulating coating.

The wire harness 60 comprises first and second trunk portions 62*a* and 62*b*, first to ninth branch portions 63, 64, 65, 66, 67, 68, 69, 70, and 71 formed by branching one end portion of each of the first and second trunk portions 62*a* and 62*b*, a first joint device 72 (indicated by the broken line) arranged on the first trunk portion 62*a* to connect two or more electric wires of the electric wires constituting the first trunk portion 62*a* so as to electrically short-circuit the branch portions 63 and 64, and a second joint device 73 (indicated by the broken line) arranged on the second trunk portion 62*b* to connect two or more electric wires of the electric wires 61 constituting the second trunk portion 62*b* so as to electrically short-circuit the branch portions 63 and 67.

The first and second trunk portions 62*a* and 62*b* are formed by integrating large numbers of electric wires having different diameters into parallel strips using the insulating coating S.

The first trunk portion 62*a* comprises a first sub-trunk portion 74 of the first flat cable F1, and a second sub-trunk portion 75 of the second flat cable F2.

The second branch portion 64 comprises second and third sub-trunk portions 77 and 78 of the second flat cable F2. The third branch portion 65 is the sub-branch portion of the second flat cable F2. With this arrangement of the wire harness, a multicore circuit can be made of two flat cables. Therefore, the number of electric wires 21 can be decreased, and the first and second joint devices 72 and 73 do not occupy a wide space, and especially the multicore harness occupies a very small space and can be easily designed.

With this arrangement of the wire harness, the measuring, tearing and cutting of the two flat cables F1 and F2 can be easily automated. Therefore, demerits due to the increase in the number of flat cables can be decreased, and the harness is small in size and can be easily designed.

Figure 17:
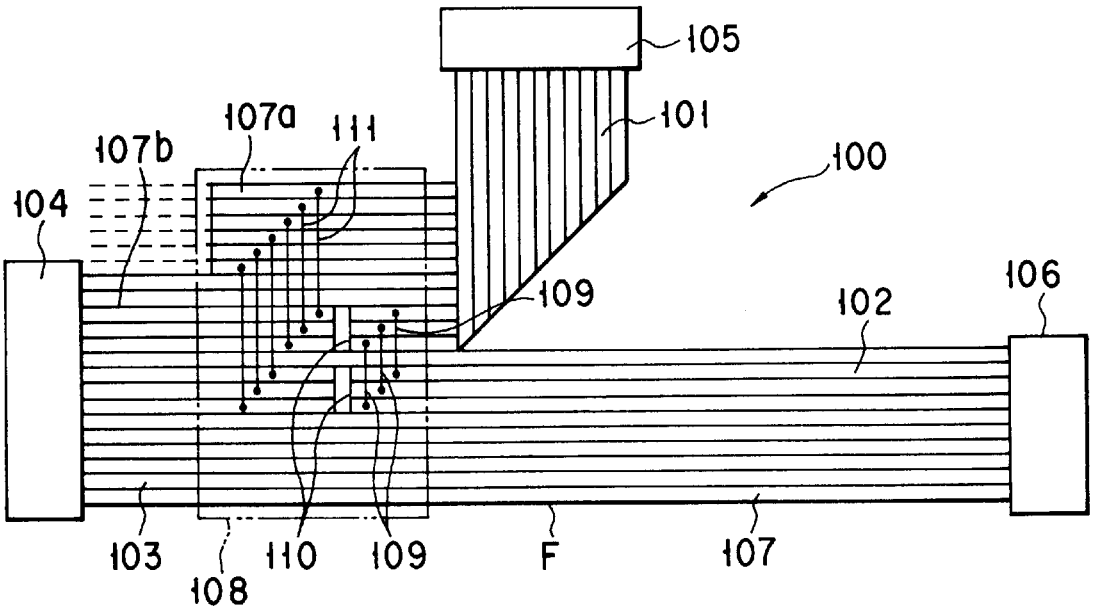
FIG. 17 is a plan view showing a wire harness according to the fourth embodiment of the present invention.

The fourth embodiment of the present invention will be described next with reference to FIG. 17. Similar to each embodiment described above, a wire harness 100 of this embodiment is designed such that two branch portions 101 and 102 are formed by tearing one end of a single flat cable F, connectors 104, 105, and 106 are attached to the end portions of a trunk portion 103 as the other end portion of the flat cable F and the branch portions 101 and 102, and a joint device 108 is arranged to short-circuit predetermined electric wires 107 of the branch portions 101 and 102.

However, the wire harness according to this embodiment of the present invention is different from each embodiment described above in the manner of handling the electric wires 107 of the trunk portion 103.

The wire harness 100 according to the fourth embodiment will be described below in comparison with the first embodiment shown in FIG. 1.

In the first embodiment, the electric wires 11 of the branch portions 13 and 14 short-circuited by the joint device 15 are designed not to be connected to the connector 16 of the trunk portion 12. For this purpose, these electric wires are cut, as indicated by the broken lines in FIG. 1. Therefore, in the wire harness 10 in FIG. 1, terminals (not shown) near the center portion of the connector 16 to which the electric wires 11 indicated by the broken lines were expected to be connected are idle terminals corresponding to the number of electric wires 11 to be short-circuited As indicated by the broken lines in FIG. 17, in the wire harness 100 of the fourth embodiment, electric wires 107*a* which are not connected to the connector 104 of the trunk portion 103 are arranged at one end portion of the flat cable F in the direction of width by the number of electric wires 107 short-circuited between the branch portions 101 and 102, i.e., the number (six in FIG. 17) of electric wires 107 connected to short-circuiting metal members 109.

All electric wires 107*b* except for the electric wires 107*a* are connected to the connector 104 of the trunk portion 103.

Of the electric wires 107*b* connected to the connector 104 of the trunk portion 103, the electric wires 107*b* short-circuiting the branch portions 101 and 102 have cut portions 110 formed by partly cutting/removing the electric wires 107*b* between a position where the short-circuiting metal members 109 are attached and a position where the electric wires 107*b* are connected to the connector 104. With these cut portions 110, conduction between the connector 104 and the electric wires 107*b* short-circuiting the branch portions 101 and 102 is disrupted.

In addition to the short-circuiting metal members 109 for short-circuiting the branch portions 101 and 102, the wire harness 100 of the fourth embodiment includes short-circuiting metal members 111 for short-circuiting the cut electric wires 107*b*, arranged between the cut portions 110 and the connector 104, and the electric wires 107*a* which are not connected to the connector 104 and arranged at one end portion in the direction of width. With these short-circuiting metal members 111, the electric wires 107*a*, of the branch portion 101, which are not connected to the connector 104 are connected to terminals, in the connector 104, which are rendered unnecessary because of short circuit between the branch portions 101 and 102.

Figure 18A:
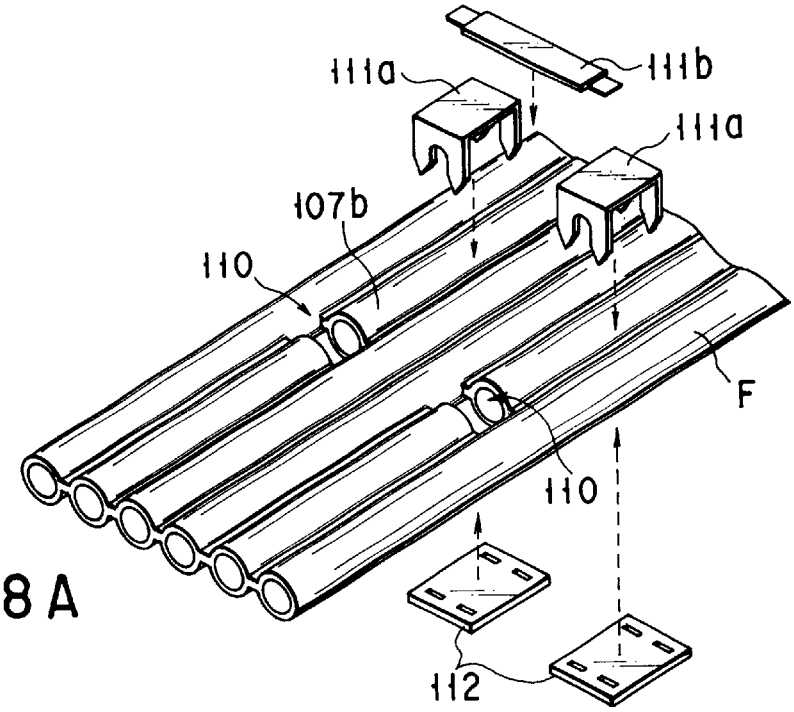
FIGS. 18A to 18C are perspective views showing an example of how a short-circuiting device used for the wire harness in FIG. 17 is mounted.
Figure 18B:
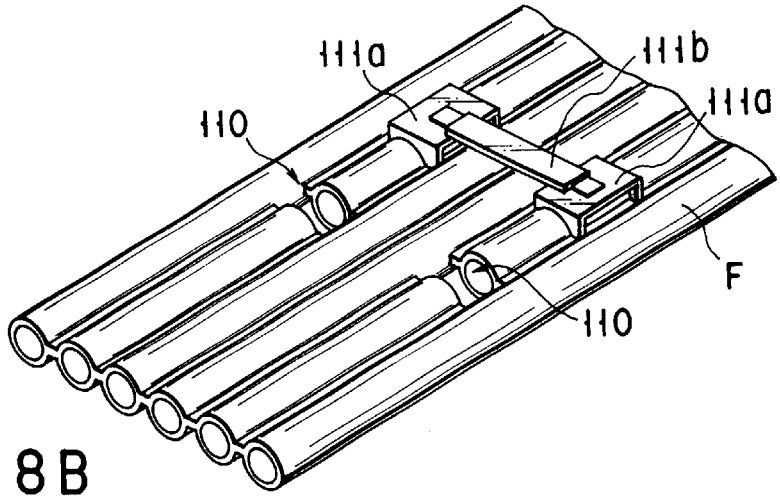

As the short-circuiting metal member 111, the joint device 108, and the like, members like those shown in FIG. 5 may be used. Alternatively, a short-circuiting metal member 111 obtained in the following manner may be used. As shown in FIG. 18A, press contact terminals 111*a* are pressed against the electric wires 107*b* having the cut portions 110 formed by punching the electric wires 107*b* to be short-circuited. As shown in FIG. 18B, the press contact terminals 111*a* are coupled to each other by resistance-welding a tape electric wire 111*b* as a flat rectangular conductor. Referring to FIG. 18A, reference numeral 112 denotes an insulating cover which is engaged with the press contact terminal 111*a* pressed against the electric wire 107*b* to hold the press contact terminal 111*a* in a press contact state.

Figure 18C:
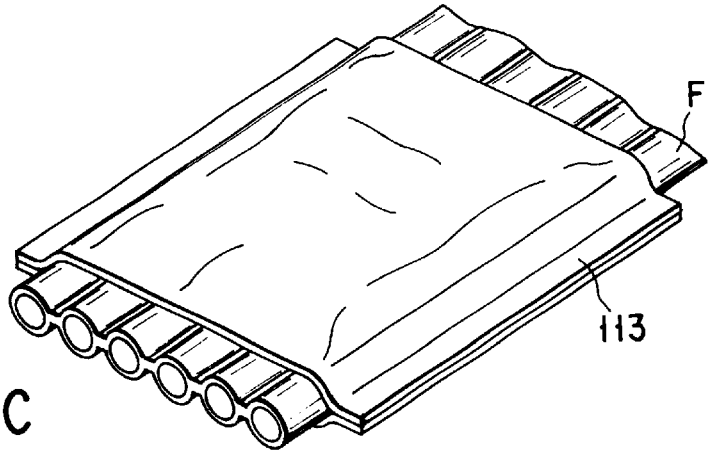

In this case, the cut portions 110 may be covered with the upper and lower casings of the joint device 108 or an adhesive tape 113 shown in FIG. 18C, together with the short-circuiting metal members 111, so as to prevent the conductors of the electric wires 107*b* from being exposed.

In addition, processes such as fixing of bent portions with an adhesive tape and mounting of clips, i.e., processes other than handling of the electric wires 107 of the trunk portion 103, may be performed in the same manner as in each embodiment described above.

According to the fourth embodiment, the idle terminals arranged near the central portion of the connector 15 in the first embodiment shown in FIG. 1 can be eliminated, and all the terminals can be effectively used. Therefore, the total number of terminals of the connector 104 can be decreased, and the with of the connector can be reduced.

Furthermore, since the trunk portion 103 of the flat cable F connected to the connector 104 is formed by integrally coupling the electric wires 107 to each other with an insulating coating, positioning of the connector 104 and the flat cable F is further facilitated as compared with the first embodiment having cut portions partly.

Figure 19:
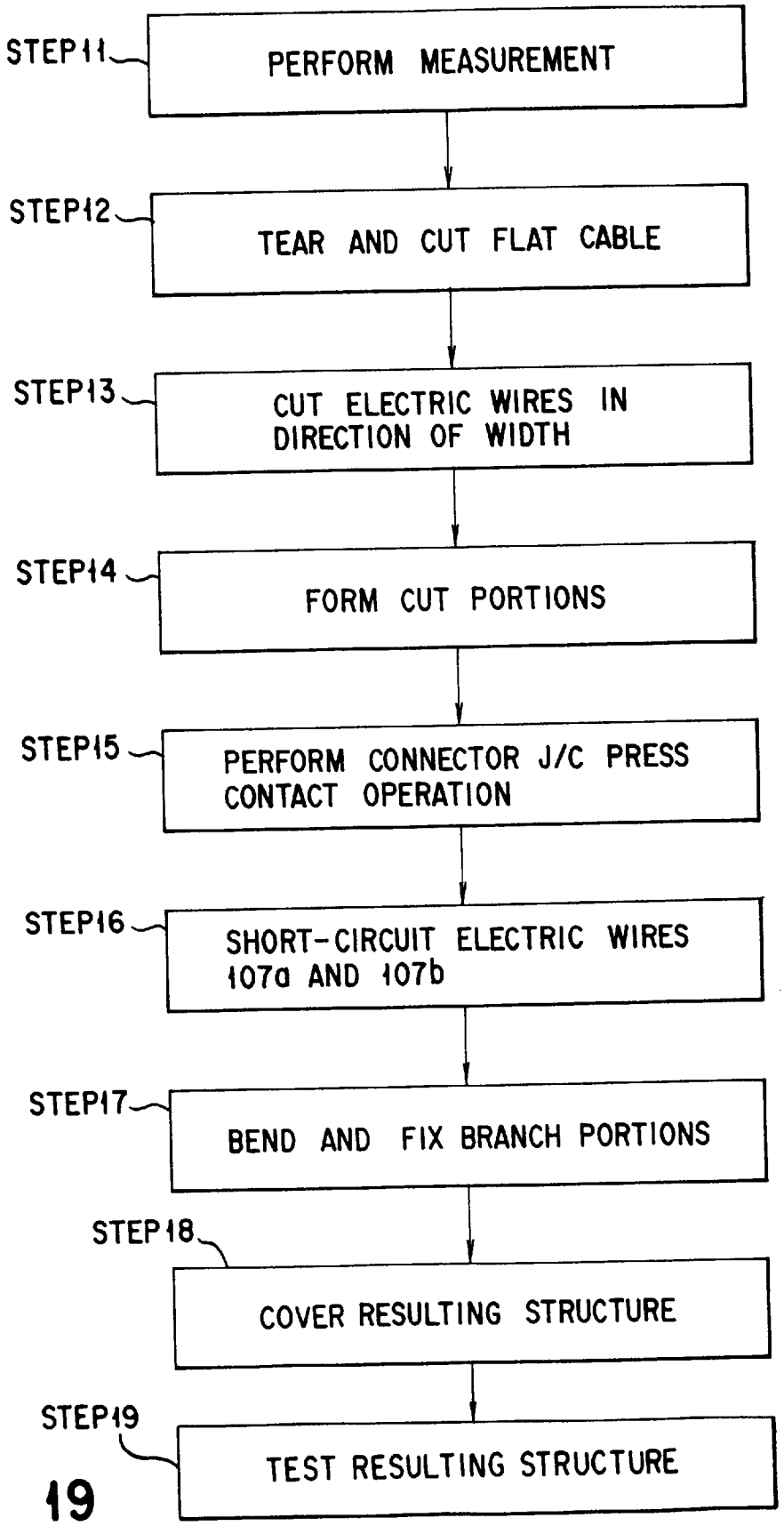
FIG. 19 is a flow chart showing a method of manufacturing the wire harness in FIG. 17.

A method of manufacturing the wire harness 100 of the fourth embodiment will be described next with reference to the flow chart shown in FIG. 19. As shown in FIG. 19, although the flow chart for this manufacturing method is almost the same as that shown in FIG. 16, the method is characterized in the contents of the tearing/cutting step and the connector J/C press contact step.

The tearing/cutting step (step 12) includes the step (step 13) of cutting the electric wires 107*a* from one end portion of the flat cable F in the widthwise direction by the same number as that of the electric wires 107*a* short-circuited between the branch portions 101 and 102 at the end portion, of the flat cable F, to which the connector 104 of the trunk portion 103 is attached, and the subsequent connector J/C press contact step (step 15) includes the step (step 14) of forming the cut portions 110 for partly cutting the electric wires 107*b*, short-circuited between the branch portions 101 and 102, at intermediate positions between the short-circuiting portions and the connector 104.

The connector J/C press contact step (step 15) includes the step (step 16) of attaching the connector 104 such that all the terminals are connected to the electric wires 107*b* equal in number to the terminals of the connector 104 arranged at the end portion of the trunk portion 103, and the step of short-circuiting portions, of the electric wires 107*b*, located between the connector 104 and the cut portions 110 formed in the electric wires 107*b* in the above step and the electric wires 107*a* which are not connected to the connector 104, by using the short-circuiting metal members 111.

Steps 17 to 19 are performed as well as steps 4 to 6 in FIG. 16.

According to this manufacturing method for the wire harness 100, the width of the connector 104 attached to the trunk portion 103 can be easily decreased substantially by only adding a simple operation of short-circuiting a plurality of electric wires 107*a* and 107*b* using the short-circuiting metal members 111.

Each step can be easily performed by avoiding a complicated operation of positioning a plurality of flat cables F to one connector 104 at once.

In addition, production of defective products can be prevented by improving the positioning precision.

Furthermore, since the wire harness 100 manufactured by the manufacturing method of the fourth embodiment includes no unnecessary electric wires which are not connected to a connector, the total weight of the wire harness can be reduced.

This wire harness is effective especially when the distance from a short-circuiting portion to the connector 104 of the trunk portion 103 is long. Steps S12 to S14 and steps 15 and 16 may be performed simultaneously.

A cross wiring method for a wire harness according to the fifth embodiment of the present invention will be described next with reference to FIGS. 20 to 24. In the cross wiring method according to the fifth embodiment, first of all, a pair of conductors 211*b* and 211*e* to be interchanged are cut at halfway positions along the longitudinal direction of a flat cable 210. With this operation, each of the conductors 211*b* and 211*e* is divided into two parts at a cut portion C.

Press contact portions 213 of terminals, each constituted by a press contact bus bar 212, are mounted on portions, of the conductors 211*b* and 211*e*, located on two sides opposing each other via the cut portions C. As a result, the conductors 211*b* and 211*e* coupled to each other via the press contact bus bars 212 are electrically connected to each other. Since the press contact bus bars 212 cross each other, a cross wiring structure can be obtained, in which the conductors 211*b* and 211*e* are interchanged in arrangement order from each other. Note that cutting of the conductors 211*b* and 211*e* and mounting of the terminals may be performed in a reverse order to the above order.

Figure 23:
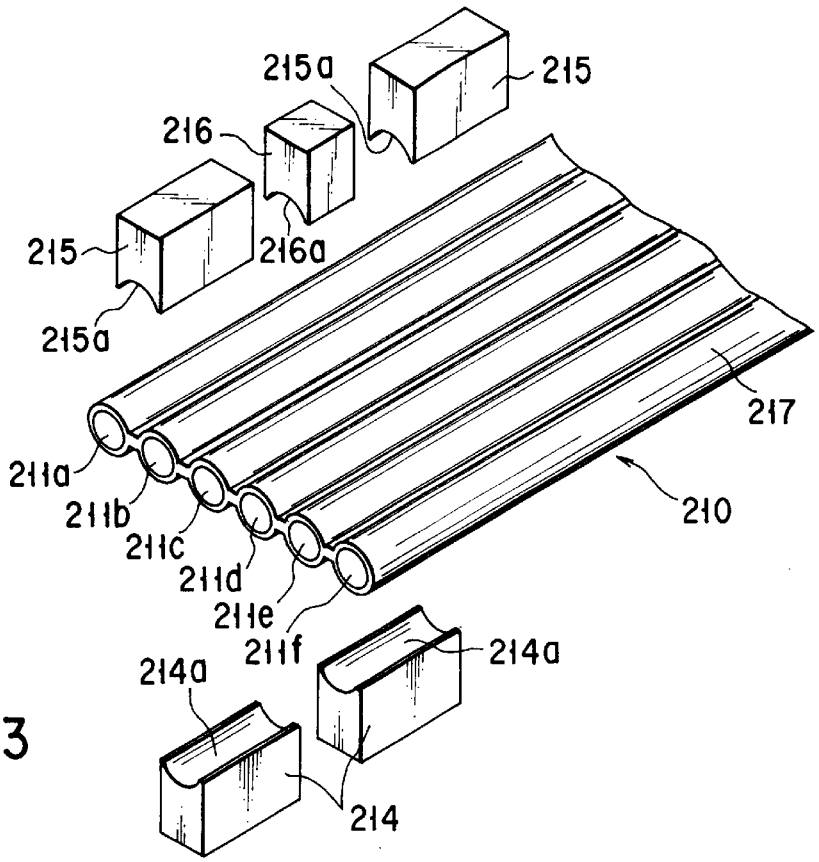
FIG. 23 is a perspective view for explaining a method of cutting a conductor in the cross wiring method in FIG. 20.
Figure 24:
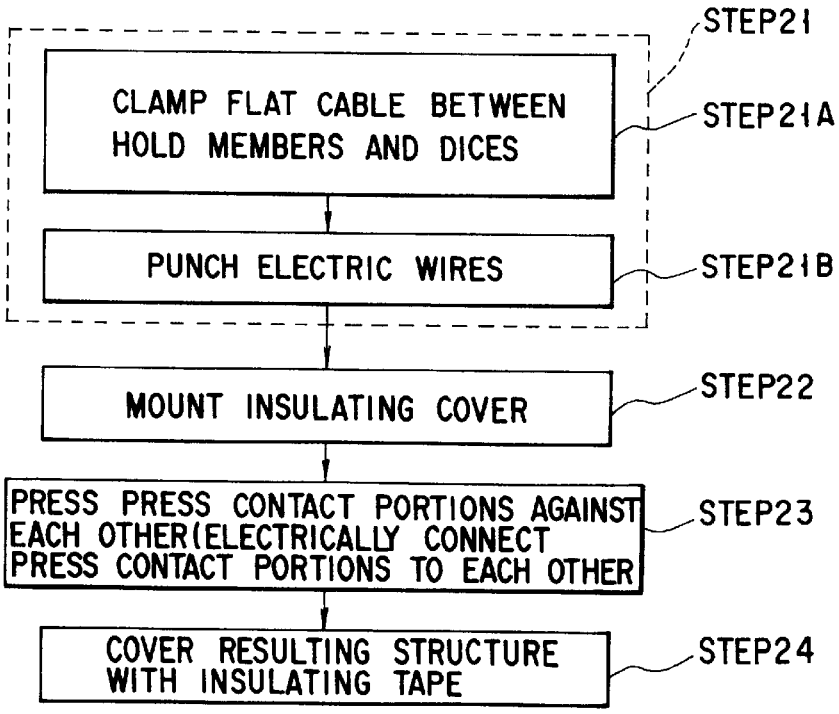
FIG. 24 is a flow chart showing the cross wiring method.

The above conductors are cut by the method shown in FIGS. 23 and 24. As shown in FIG. 23, dices 214 are arranged below the conductor 211*b*, of the flat cable 210, which is to be cut, and hold members 215 are arranged above the conductor 211*b*. The conductor 211*b* is then clamped between the dices 214 and the hold members 215. Two pairs of dices 214 and hold members 215 are spaced apart from each other in the longitudinal direction of the flat cable 210. Recesses 214*a* and 215*a* of the dices 214 and the hold members 215 are brought into tight contact with the outer surface of the flat cable 210 to clamp the flat cable 210 from above.

A punch 216 which is lowered to the flat cable 210 independently of the hold members 215 is arranged between the hold members 215. Sharp cutters 216*a* are formed on all the edge portions of the lower surface of the punch 216. The punch 216 is punched downward on the flat cable 210 vertically clamped between the hold members 215 and the dices 214.

With this operation, an insulator 217 is cut by the cutters 216*a* of the punch 216, and the conductor 211*b* in the flat cable 210 is cut by a shearing force produced by the punch 216*a* and the dices 214. The desired conductor 211*b* is punched through at a halfway position along its longitudinal direction to be divided into two parts. The other conductor 211*e* to be interchanged in arrangement order with the conductor 211*b* is cut in the same manner as described above.

Figure 20:
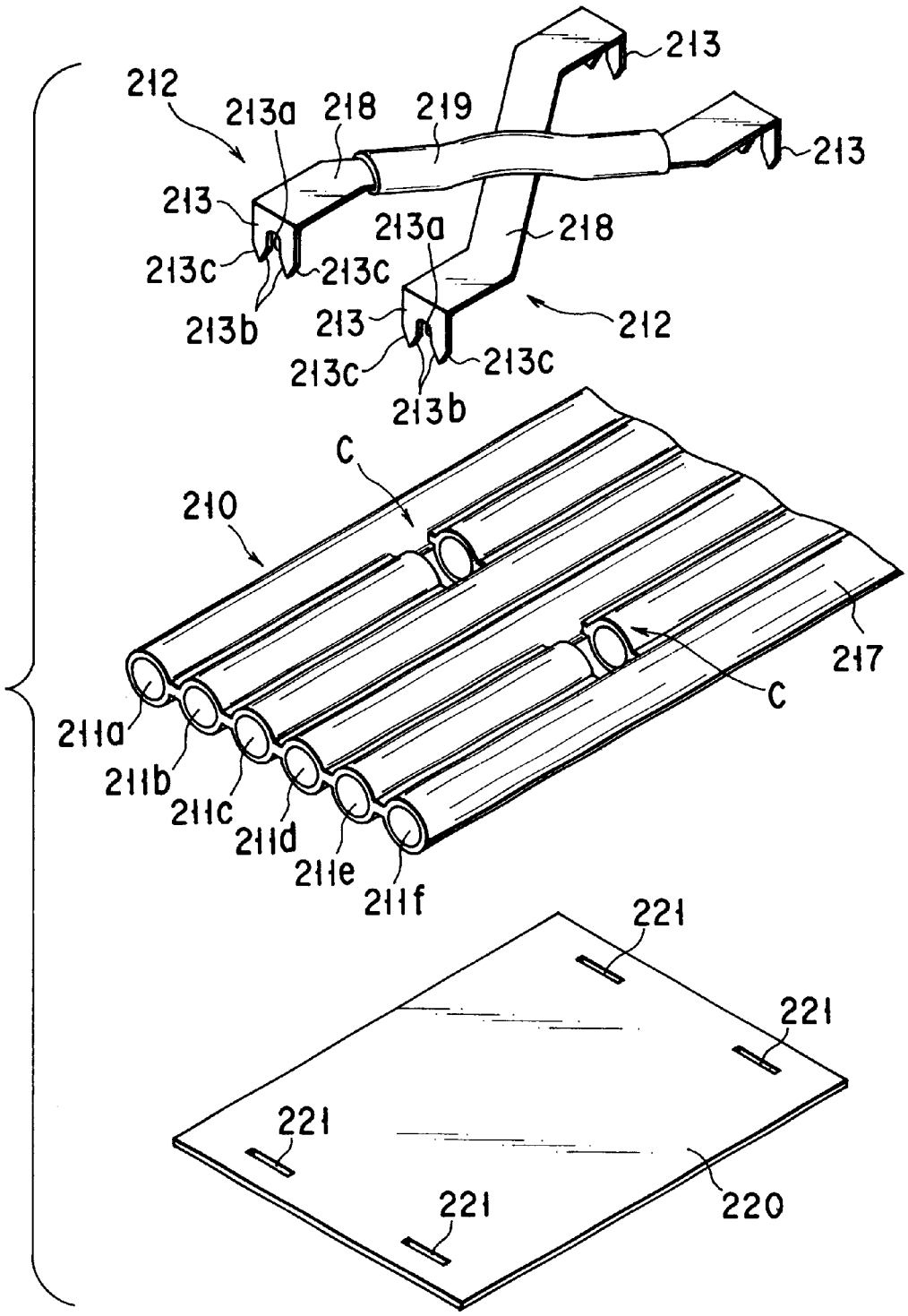
FIG. 20 is a perspective view showing a cross wiring method for a wire harness according to the fifth embodiment of the present invention.

As shown in FIG. 20, the press contact bus bar 212 is punched from a thin metal plate and bent into a U-shaped member having press contact portions 213 (terminals) formed at its two ends to be integrally coupled to each other via a coupling portion (coupling member) 218. The press contact portions 213 are bent at a right angle in the same direction with respect to the flat strip-like coupling portion 218, and have slits 213*a* open to the distal ends. These slits 213*a* are formed to have a width smaller than the diameter of the conductors 211*b* and 211*e* in the flat cable 210.

The distal ends of the press contact portions 213 are sharpened to each bite into the insulators 217 against which the press contact portions 213 are pressed. Each press contact portion 213 has guide portions 213*b* formed at its distal end to be tapered narrower gradually toward the slit 213*a*, and inclined portions 213*c* formed on the outside of the guide portions 213*b* to be tapered narrower gradually toward the distal end. The guide portions 213*b* serve to guide the conductors 211*b* and 211*e*, against which the press contact portions 213 are pressed, into the slits 213*a*. When the press contact portions 213 are inserted into insertion holes (to be described later), the inclined portions 213*c* serve to bias the press contact portions 213 inward in the direction of width to hold the press contact portions 213 while preventing an increase in width of the slits 213*a*.

The press contact portions 213 are arranged to be parallel to each other. Each coupling portion 218 is formed such that when one press contact portion 213 is arranged to be perpendicular to one conductor 211*b*, the other electric wire 213 can be arranged to be perpendicular to the other conductor 211*e* to be interchanged in arrangement order. The press contact bus bars 212 formed in this manner are arranged in pairs to cross each other so as to couple the conductors 211*b* and 211*e* in different lines to each other across the cut portions C.

Figure 21:
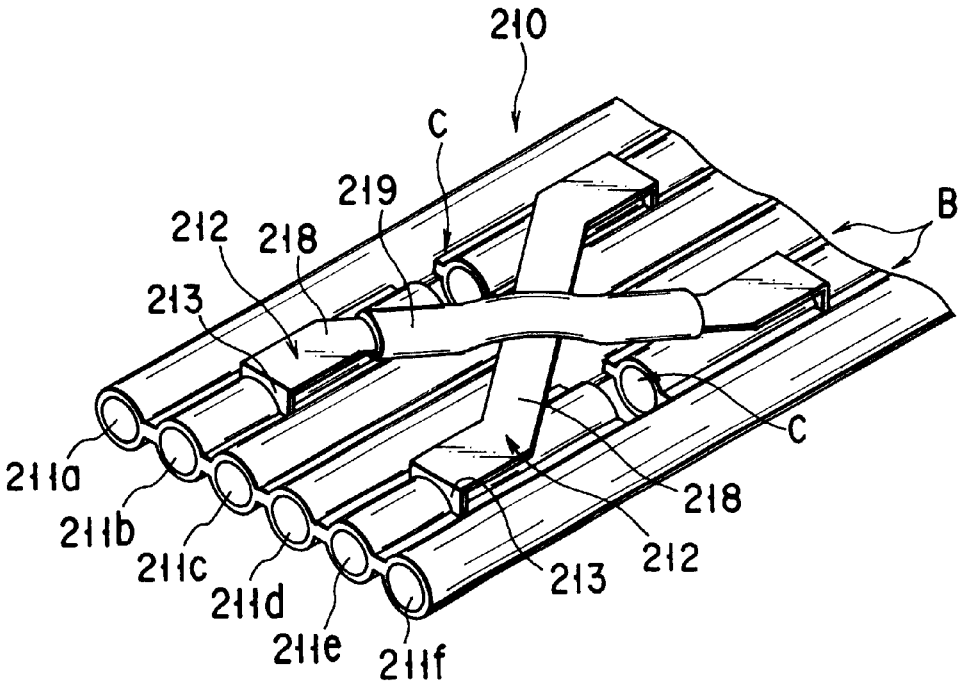
FIG. 21 is a perspective view showing a cross wiring structure formed by the cross wiring method in FIG. 20, and a flat cable having this cross wiring structure.

Referring to FIGS. 20 and 21, reference numeral 219 denotes an insulating tube which covers the coupling portion 218 of one press contact bus bar 212 to insulate the press contact bus bar 212 from the other press contact bus bar 212 which crosses one press contact bus bar 212. Reference numeral 220 denotes an insulating cover which covers a surface, of the flat cable 210, located on the opposite side to the surface on which the press contact bus bars 212 are mounted. Insertion holes 221 are formed in the insulating cover 220. The press contact portions 213 pressed against the conductors 211*b* and 211*e* are inserted into the insertion holes 221. The insertion holes 221 hold the press contact portions 213 in the direction of width and prevent an increase in the width of slits 213*a*.

A case wherein conductors 211*a* to 211*f* at two ends of the flat cable 210 are interchanged in arrangement order from each other by the cross wiring method of the fifth embodiment will be described below with reference to the flow chart shown in FIG. 24.

First of all, the conductors 211*b* and 211*e*, of the flat cable 210, which are to be interchanged in arrangement order are cut at halfway positions along the longitudinal direction (step 21). This cutting step is performed as follows. As shown in FIG. 23, the hold members 215 and the dices 214 are vertically brought close to the flat cable 210 in a horizontal position to clamp the pair of conductors 211*b* and 211*e*, which are to be interchanged in arrangement order from each other, at halfway positions along the longitudinal direction (step 21A). The punch 216 is then punched on the conductors 211*b* and 211*e* (step 21B). In this case, the cut portions C of the conductors 211*b* and 211*e* preferably arranged at substantially the same position in the longitudinal direction of the flat cable 210.

The insulating cover 220 is arranged on the lower surface of the flat cable 210 at a position near the cut portions C formed in the above manner (step 22). One press contact portion 213 of each press contact bus bar 212 is positioned with respect to one conductor 211*b* of the conductors 211*b* and 211*e*, and the other press contact portion 213 is positioned with respect to the other conductor 211*e* across the cut portion C. The two press contact portions 213 are then pressed against the side surfaces of the flat cable 210 (step 23). With this operation, the distal end of each press contact portion 213 bites into the insulator 217 of the flat cable 210 to be brought into contact with a corresponding one of the conductors 211*b* and 211*e*. The conductors 211*b* and 211*e* guided by the guide portions 213*b* are then inserted into the slits 213*a* of the press contact portions 213. In addition, the distal ends of the respective press contact portions 213 extending through the flat cable 210 are inserted into the insertion holes 221 of the insulating cover 220.

Figure 22:
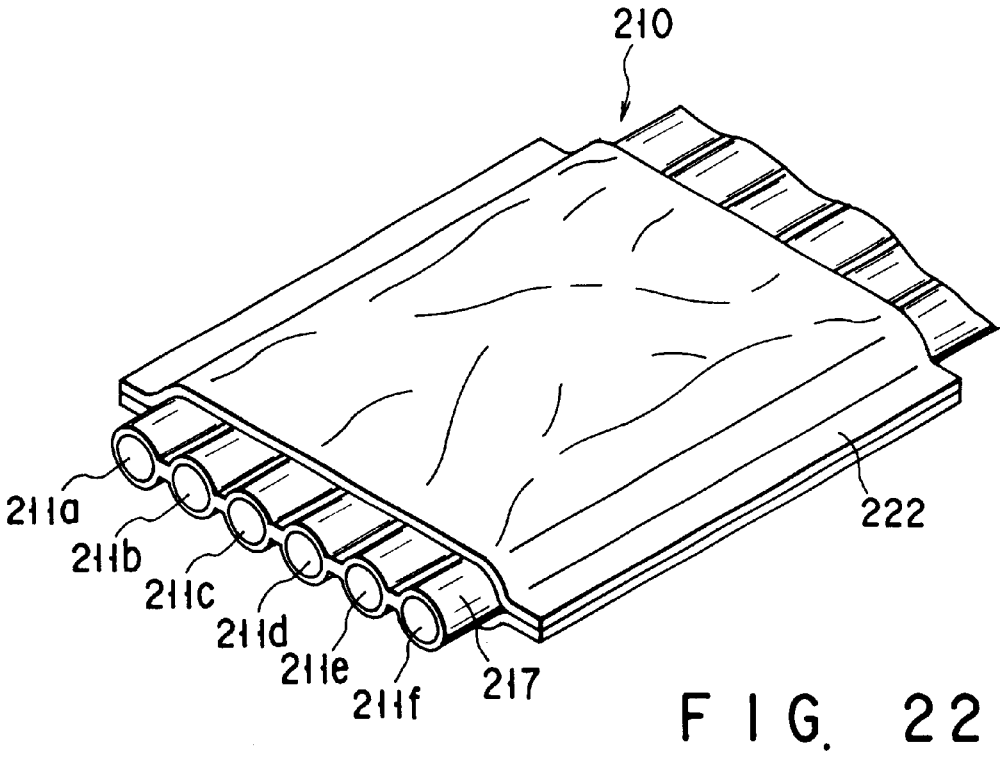
FIG. 22 is a perspective view showing a state wherein the cross wiring structure in FIG. 21 is covered with insulating adhesive tapes.

Since the width of the slits 213*a* is smaller than the diameter of the conductors 211*b* and 211*e*, the conductors 211*b* and 211*e* are pressed against the slits 213*a* to be electrically connected to the press contact bus bars 212, and the press contact state is maintained by the insertion holes 221 of the insulating cover 220. With this operation, the conductors 211*b* and 211*e* arranged at different arrangement positions across the cut portions are electrically connected to each other via the coupling portions 218. Subsequently, as shown in FIG. 22, the press contact bus bars 212 mounted on the flat cable 210 and the cut portions C of the flat cable 210 are covered with an adhesive tape 222 having insulation properties (step 24), thereby maintaining the insulation properties with respect to the external environment.

According to the cross wiring method of the fifth embodiment, therefore, by only coupling the cut conductors 211*b* and 211*e* to each other via the press contact bus bars 212, the arrangement order of the conductors 211*a* to 211*f* at the two ends of the flat cable 210 can be changed, for example, as follows: 211*a*, 211*e*, 211*c*, 211*d*, and 211*f*. Therefore, a connecting operation is facilitated, and the work efficiency can be improved. In addition, since the above connecting operation can be performed at arbitrary positions in the longitudinal direction of the flat cable 210, the insulators 217 between adjacent conductors at one end portion of the flat cable 210 need not be torn, and the arrangement pitch of the conductors 211*a* and to 211*f* can be maintained.

In the cross wiring structure formed by the cross wiring method of the fifth embodiment, the press contact bus bars 212 are electrically connected to the conductors 211*b* and 211*e* of the press contact bus bars 212 by causing the press contact portions 213 to bite into the insulators 217 between adjacent conductors. For this reason, the number of insulators 217 to be cut off is minimized.

Furthermore, in the flat cable 210 having the cross wiring structure of this embodiment, since no insulators 217 between adjacent conductors are torn at the two end portions of the flat cable 210, the pitch of the conductors at the two end portions can be kept constant. With this arrangement, all the conductors 211*a* to 211*f* can be exposed at the end portions of the flat cable 210 at once, and the positions of the exposed conductors 211*a* to 211*f* can be accurately controlled. Therefore, positioning of terminals (not shown) or the like with respect to the conductors 211*a* to 211*f* is facilitated, and batch positioning, batch contact bonding, and the like can be performed. As a result, terminal processes can be automated.

A cross wiring method according to the sixth embodiment of the present invention will be described next with reference to FIGS. 25 to 28. First of all, for example, a pair of conductors 311*b* and 311*f* to be interchanged from each other are cut at halfway positions along the longitudinal direction of a flat cable 310. With this operation, each of the conductors 311*b* and 311*f* is divided into two parts at a cut portion C. Press contact terminals 312 are mounted on portions, of the conductors 311*b* and 311*f*, located on two sides opposing each other via the cut portions C.

The press contact terminals 312 are then coupled to each other via short-circuiting electric wires 313. With this operation, the conductors 311*b* and 311*f* against which the press contact terminals 312 are pressed are electrically connected to each other. In this case, since the short-circuiting electric wire 313 cross each other, a cross wiring structure can be obtained, in which the conductors 311*b* and 311*f* are interchanged in arrangement order from each other. Note that cutting of the conductors 311*b* and 311*e* and mounting of the press contact terminals 312 may be performed in a reverse order to the above order.

The above conductors are cut by the same method as in the fifth embodiment.

Figure 25:
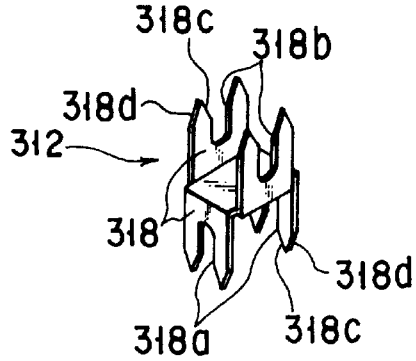
FIG. 25 is a perspective view showing a press contact terminal used for cross wiring of a wire harness according to the sixth embodiment of the present invention.

As shown in FIG. 25, the press contact bus bar 312 is punched from a thin metal plate and bent into a shape having two pairs of press contact ends 318 integrally coupled to each other having slits 318*a* and 318*b* open in opposite directions. These slits 318*a* and 318*b* are formed to have a width smaller than the diameter of the conductors 311*b* and 311*f* in the flat cable 310 or a conductor 313*a* of the short-circuiting electric wire 313.

The distal ends of the press contact ends 318 are sharpened to easily bite into insulators 317 and 313*b*. Each press contact end 318 has guide portions 318*c* formed at its distal end to be tapered narrower gradually toward the slits 318*a* and 318*b*, and inclined portions 318*d* formed on the outside of the guide portions 318*b* to be tapered narrower gradually toward the distal end. The guide portions 318*c* serve to guide the conductors 311*b*, 311*f*, and 313*a*, against which the press contact ends 318 are pressed, into the slits 318*a* and 318*b*. When the press contact ends 318 are inserted into holding recesses (not shown), the inclined portions 318*d* bias the press contact ends 318 inward in the direction of width via the holding recesses, thereby holding the press contact ends 318 while preventing an increase in the width of the slits 318*a* and 318*b*.

The short-circuiting electric wires 313 are covered wires which are not exposed. When the short-circuiting electric wires 313 are pressed against the press contact ends 318 of the press contact terminals 312 pressed against the flat cable 310, the conductors 313*a* is pressed against the slits 318*b* while the insulators 313*b* are bitten.

As shown in FIG. 25, the cross wiring structure of the sixth embodiment has a flat housing 320 arranged between the flat cable 310 and the short-circuiting electric wires 313, and a cover member 321 for covering the housing 320 and the joining portions between the short-circuiting electric wires 313 and the press contact terminals 312.

The housing 320 has a plurality of through holes 320*a* formed to extend therethrough in the direction of thickness and arranged in accordance with the pitch of the conductors 311*a* to 311*f* of the flat cable 310. In the case shown in FIGS. 25 and 26, a total of 18 through holes 320*a*, i.e., 6 (row)×3 (column), are formed. When the housing 320 is aligned with one side surface of the flat cable 310, the through holes 320*a* are positioned with respect to the conductors 311*a* to 311*f* such that three through holes 320*a* are aligned along the longitudinal direction of each conductor.

In this case, when the middle through hole 320*a* of the three through holes 320*a* is located to coincide with the cut portion C of the flat cable 310, the through holes 320*a* located on both sides of the middle through hole 320*a* are located at positions where the press contact terminals 312 are to be pressed against the conductors. Therefore, when the housing 320 is aligned with one side surface of the flat cable 310, and the press contact terminals 312 are caused to extend through the through holes 320*a* to press against the conductors 311*a* to 311*f* in this state, the press contact terminals 312 can be orderly mounted on the flat cable 310.

In the above case, three through holes 320*a* are aligned for each conductor. However, at least two through holes 320*a* need only be arranged to allow insertion of the press contact terminals 312.

Figure 27:
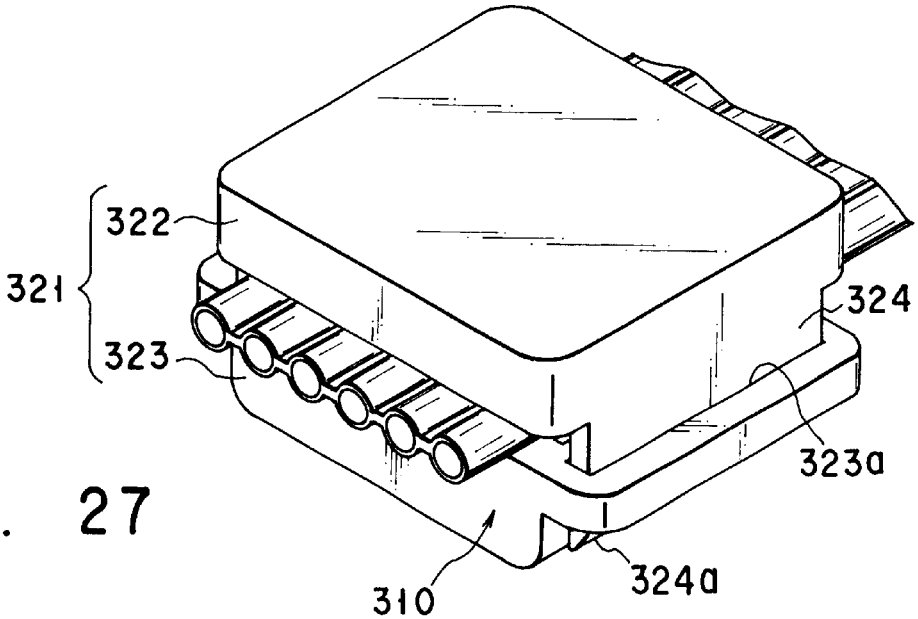
FIG. 27 is a perspective view showing a state wherein a cover is mounted on the structure in FIG. 26.
Figure 28:
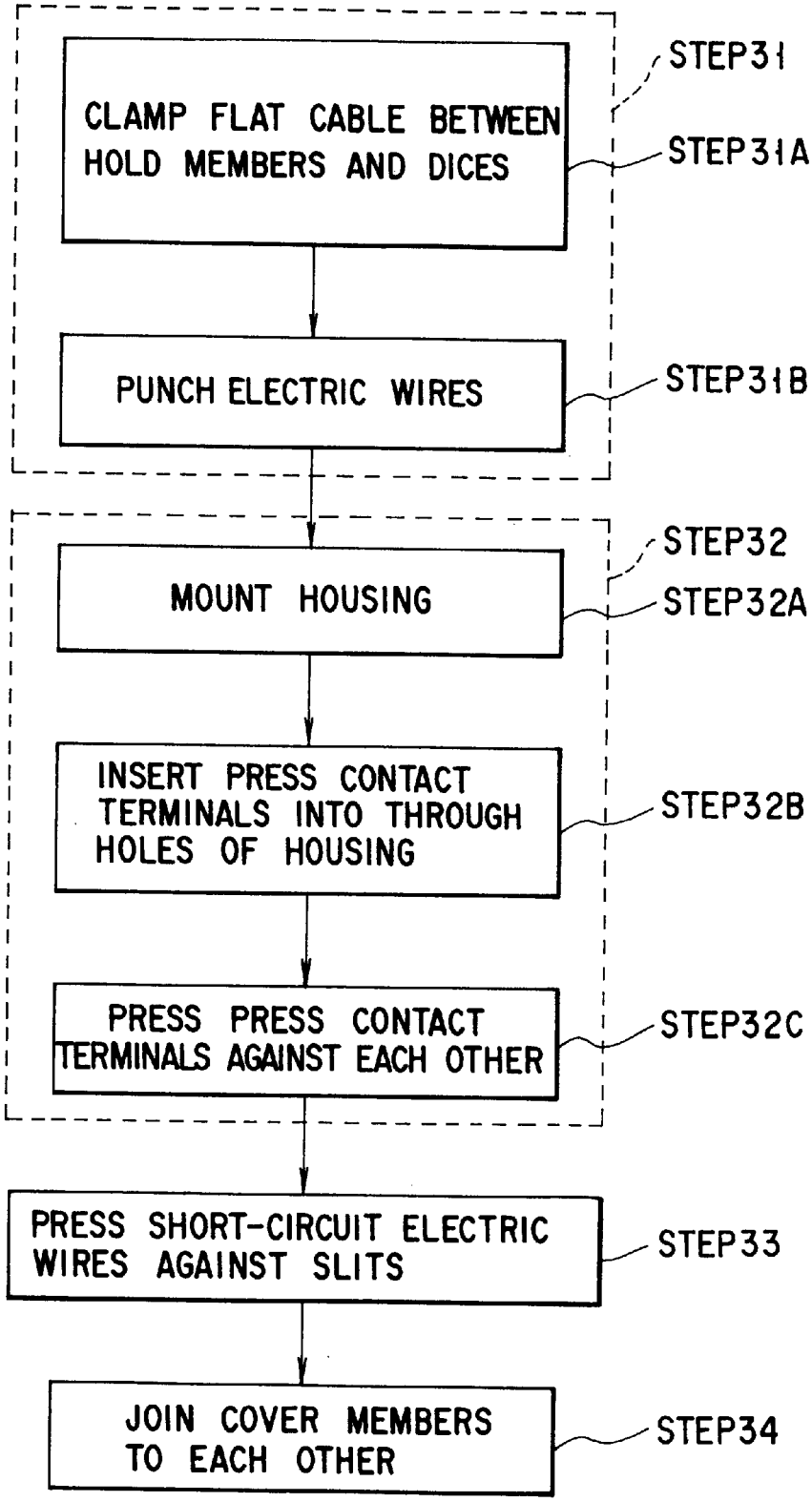
FIG. 28 is a flow chart showing the cross wiring method of producing the cross wiring structure in FIG. 26.

For example, as shown in FIG. 27, the cover member 321 comprises upper and lower covers 322 and 323. The upper and lower covers 322 and 323 are joined to each other from above and below the flat cable 310 to clamp it. For example, the upper cover 322 has a flexible engaging piece 324 having an engaging projection 324*a* at its distal end. The lower cover 323 has a lock hole 323*a* which allows the engaging piece 324 to extend therethrough. The engaging piece 324 is bent and inserted into the lock hole 323*a*. When the engaging projection 324*a* passes through the lock hole 323*a*, the engaging projection 324*a* is locked to the lower opening end of the lock hole 323*a* with the recovered elastic force of the engaging piece 324, thereby maintaining the upper and lower covers 322 and 323 in a joined state.

The upper and lower covers 322 and 323 have recesses (not shown) for housing the press contact terminals 312 extending upward from the housing 320 and the short-circuiting electric wires 313 and recess 323*b* for housing the press contact terminals 312 extending downward from the flat cable 310. Insertion recesses 319 are formed in the bottom and top surfaces of the recess 323*b*. Each insertion recess 319 has an inclined surface 319*a* tapered wider toward the direction of opening. When the inclined surfaces 319*a* are pressed against the inclined portions 318*d* of the press contact terminals 312 while the upper and lower covers are joined to each other, the press contact ends 318 are biased to be compressed in the direction of width so as to prevent an increase in the width of the slits 318*a* and 318*b*.

Figure 26:
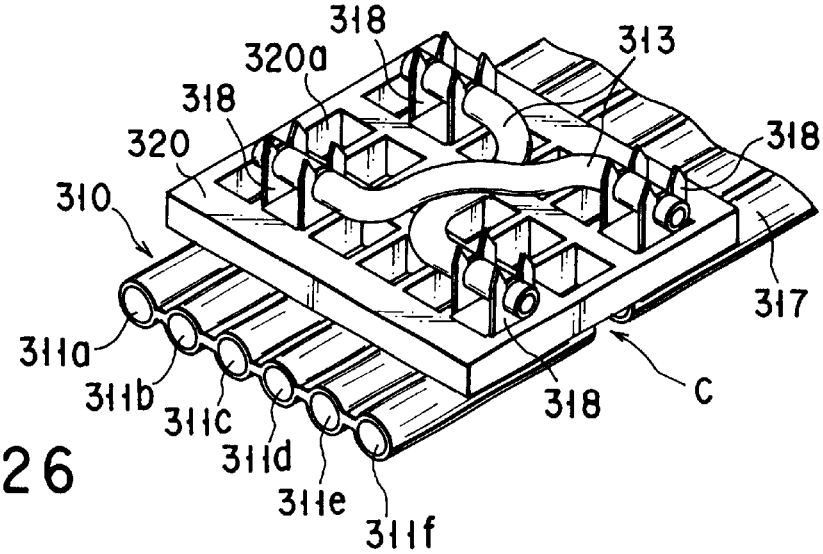
FIG. 26 is a perspective view showing the cross wiring structure of the wire harness.

A case wherein the conductors 311*a* to 311*f* at two ends of the flat cable 310 are interchanged in arrangement order from each other by the cross wiring method of this embodiment will be described below with reference to the flow chart shown in FIG. 26.

In the cross wiring method of this embodiment, first of all, hold members 315 and dices 314 are brought close to the flat cable 310 in a horizontal position from above and below to clamp a pair of conductors 311*b* and 311*f*, which are to be interchanged in arrangement order from each other, at half-way positions along the longitudinal direction (step 31A). Punches 316 are then punched on the conductors 311*b* and 311*f* (step 31B) to cut the conductors 311*b* and 311*f* (step 31). In this case, the cut portions C of the conductors 311*b* and 311*f* are preferably located at substantially the same position in the longitudinal direction of the flat cable 310.

Subsequently, the housing 320 is placed on the upper surface of the flat cable 310 such that the middle through holes 320*a* coincide with the cut portions C (step 32A). The press contact terminals 312 are inserted into the through holes 320*a* located on both sides of the cut portions C (step 32B). The press contact terminals 312 are then pressed against the upper surface of the flat cable 310 (step 32C). With this operation, the press contact ends 318 of the two-stage press contact terminals are caused to bite into insulators 317 and press against the conductors 311*b* and 311*f* in the flat cable 310 (step 32).

In this case, the conductors 311*b* and 311*f* are guided/inserted into the slits 318*a* of the press contact portions. Since the width of the slits 318*a* is smaller than the diameter of the conductors 311*b* and 311*f*, the conductors 311*b* and 311*f* are pressed against the slits 318*a* to be electrically connected to the press contact terminals 312 reliably. In this state, the other press contact end 318 of each press contact terminal 312 extends upward from the upper surface of the housing 320, and the slit 318*b* is open upward. The short-circuiting electric wires 313 are then pushed downward into the slits 318*b* (step 33). As a result, the conductors 313*a* are guided by the guide portions 318*c* to be inserted into the slits 318*b* of the press contact ends 318 while the insulators 313*b* of the short-circuiting electric wires 313 are bitten. Similar to the slits 318*a*, the slits 318*b* are formed to have a width smaller than the diameter of the conductors 313*a*, and the slits 318*b* can be reliably pressed against the conductors 313*a* to realize proper conduction therebetween.

In pressing the short-circuiting electric wires 313 against the press contact terminals 312, if the short-circuiting electric wires 313 are caused to cross each other on the housing 320, and the press contact ends 318 in press contact with the different conductors 311*b* and 311*f* are coupled to each other across the cut portions C, the arrangement order of the conductors 311*a* to 311*f* at two ends of the flat cable 310 can be changed.

After this operation, the press contact terminals 312 connected in this manner and the joining portions between the flat cable 310 and the short-circuiting electric wires 313 are covered with the cover member 321 (step 34). With this operation, the joining portions are maintained in a proper joined state.

According to the cross wiring method of the sixth embodiment, therefore, the arrangement order of the conductors 311*a* to 311*f* at two ends of the flat cable 310 can be easily changed by a simple connecting operation of connecting the press contact terminals 312, which are pressed against the conductors 311*b* and 311*f* partly cut at halfway positions along the longitudinal direction, to each other using the short-circuiting electric wires 313. In addition, since the above connecting operation can be performed at arbitrary positions in the longitudinal direction of the flat cable 310, the insulators 317 at one end portion of the flat cable 310 need not be torn, and the array pitch of the conductors 311*a* and to 311*f* can be maintained.

In addition, since the press contact terminals 312 and the short-circuiting electric wires 313 are separated from each other, this method can be flexibly applied, by properly adjusting the lengths of the short-circuiting electric wires 313, to a case wherein arbitrary conductors of the conductors 311*a* to 311*f* are to be interchanged in arrangement order from each other. Since each press contact terminal 312 is joined to a corresponding one of the conductors 311*b* and 311*f*with the two press contact ends 318, a stable joined state can be maintained.

Furthermore, since the insulators 317 of the flat cable 310 having the cross wiring structure of the sixth embodiment are not torn at its two end portions, the pitch of the conductors 311*a* to 311*f* at the two end portions can be kept constant. For this reason, all the conductors 311*a* to 311*f* can be exposed at the end portions of the flat cable 310 at once, and the positions of the exposed conductors 311*a* to 311*f* can be accurately controlled. Therefore, positioning of terminals (not shown) or the like with respect to the conductors 311*a* to 311*f* is facilitated, and batch positioning, batch contact bonding, and the like can be performed. As a result, terminal processes can be automated.

In this embodiment, the pair of conductors 311*b* and 311*f* are interchanged in arrangement order at two ends of the flat cable 310. The embodiment can be applied to a case wherein arbitrary conductors are interchanged in arrangement order. In addition, the embodiment may be applied to a case wherein two or more conductors of the conductors 311*a* to 311*f* are interchanged in arrangement order from each other, instead of the pair of conductors 311*b* and 311*f*. In this case, an even number or an arbitrary number of conductors may be interchanged from each other.

Furthermore, the type of conductors 311*a* to 311*f* constituting the flat cable 310 is not limited. For example, this embodiment may be applied to flat cables 310 constituted by single wires, flat rectangular wires, stranded wires, and the like. In addition, the number, thickness, and pitch of the conductors 311*a* to 311*f* and the material for the insulators 317 are not limited.

Additional advantages and modifications will readily occur to those skilled in the art. Therefore, the invention in its broader aspects is not limited to the specific details, representative devices, and illustrated examples shown and described herein. Accordingly, various modifications may be made without departing from the spirit or scope of the general inventive concept as defined by the appended claims and their equivalents.

What is claimed is:

1. A wire harness comprising:

a substantially flat cable including a plurality of parallel electric wires covered with an insulating coating for insulating said wires and for maintaining said wires substantially parallel, said cable including a trunk portion separating into at least first and second branch portions;

a connector provided at a distal end of said trunk portion; and a joint device spaced from said connector and electrically connecting at least two wires, including a first wire extending from said joint device into said first branch portion and a second wire extending from said joint device into said second branch portion, said joint device thereby short circuiting said first and second branch portions;

wherein said first and second wires are electrically disconnected from said connector between said joint device and said connector.

2. The wire harness of claim 1, wherein said joint device includes an upper casing portion, a lower casing portion, and a short circuiting member arranged in at least one of an upper and lower casing portion to electrically connect said at least two wires.

3. The wire harness of claim 2, wherein each said short circuiting member includes a pair of terminal portions for penetrating the insulating coating of the respective electrical wires and a coupling portion electrically connecting said terminal portions.

4. The wire harness of claim 1, wherein the first and second wires are each cut into a first part and a second part, and wherein the joint device includes a first short circuiting member for electrically connecting the first part of the first wire to the second part of the second wire and a second short circuiting member for electrically connecting the second part of the first wire to the first part of the second wire.

5. A wire harness comprising:

a substantially flat cable including a plurality of parallel electric wires covered with an insulating coating for insulating said wires and for maintaining said wires substantially parallel, said cable including a trunk portion separating into at least first and second branch portions, said electric wires including a first group of wires having a first diameter, and a second group of wires having a second diameter greater than said first diameter, wherein the insulating coating covering said first group of wires has a first thickness and the insulating coating covering said second group of wires has a second thickness that is smaller than said first thickness; and a joint device electrically connecting at least two wires, including a first wire extending into said first branch portion, and a second wire extending into said second branch portion, thereby short circuiting said first and second branch portions.

6. A wire harness of claim 5, wherein said joint device electrically connects a first wire from said first group of wires and a second wire from said first group of wires.

7. The wire harness of claim 5, wherein said joint device electrically connects a first wire from said first group of wires and a second wire from said second group of wires.

8. The wire harness of claim 5, wherein all of the wires of each of the first and second groups of wires defining said cable are separated from one another with substantially the same pitch.

9. The wire harness of claim 5, wherein said joint device includes an upper casing portion, a lower casing portion, and a short circuiting member arranged in at least one of an upper and lower casing portion to electrically connect said at least two wires.

10. The wire harness of claim 9, wherein each said short circuiting member includes a pair of terminal portions for penetrating the insulating coating of the respective electrical wires and a coupling portion electrically connecting said terminal portions.

11. The wire harness of claim 5, wherein the first and second wires are each cut into a first part and a second part, and wherein the joint device includes a first short circuiting member for electrically connecting the first part of the first wire to the second part of the second wire and a second short circuiting member for electrically connecting the second part of the first wire to the first part of the second wire.

12. A wire harness comprising:

first and second adjacent substantially flat cables, each cable including a plurality of parallel electric wires covered with an insulating coating for insulating the wires and for maintaining the wires substantially parallel, wherein the plurality of parallel electric wires of each cable includes at least a first wire having a first diameter and a second wire having a second diameter greater than the first diameter, and wherein the insulating coating covering the first wire has a first thickness and the insulating coating covering the second wire has a second thickness that is smaller than the first thickness; and said first and second flat cables further including first and second trunk portions and at least first, second and third branch portions including wires extending from at least one of said first and second trunk portions;

a first joint device provided on the first trunk portion to electrically connect at least two wires of said first trunk portion, thereby electrically short circuiting said first and second branch portions; and a second joint device provided on said second trunk portion, connecting at least two wires of said second trunk portion, thereby electrically short circuiting the second and third branch portions.

13. The wire harness of claim 12, wherein said first trunk portion includes a first sub-trunk portion of said first cable, and a second sub-trunk portion of said second cable.

14. The wire harness of claim 12, wherein said joint device includes an upper casing portion, a lower casing portion, and a short circuiting member arranged in at least one of an upper and lower casing portion to electrically connect said at least two wires.

15. The wire harness of claim 14, wherein each said short circuiting member includes a pair of terminal portions for penetrating the insulating coating of the respective electrical wires and a coupling portion electrically connecting said terminal portions.

16. The wire harness of claim 12, wherein the at least two wires of the first and second branch portions each includes a first wire and a second wire, the first and second wires of at least one of the first and second branch portions being cut into a first part and a second part, and wherein the joint device of the at least one branch portion includes a first short circuiting member for electrically connecting the first part of the first wire to the second part of the second wire and a second short circuiting member for electrically connecting the second part of the first wire to the first part of the second wire.

17. A wire harness comprising:

a substantially flat cable including a plurality of electric wires covered with insulating coating for insulating said wires and for maintaining said wires substantially parallel, said cable including a trunk portion separating into at least first and second branch portions, said trunk portion including first and second groups of wires;

a connector provided at a distal end of said trunk portion, wherein said second group of wires are electrically connected to said connector, and said first group of wires are not electrically connected to said connector, and wherein a portion of said second group of wires and all of said first group of wires define said first branch portion, and the remainder of said second group of wires define said second branch portion;

a first short circuiting member electrically connecting a wire from said second group of wires defining said first branch portion and a wire from said second group of wires defining said second branch portion; and a second short circuiting member electrically connecting a wire from said first group of wires defining said first branch portion and a wire from said second group of wires defining said second branch portion;

wherein a cut portion is provided at a position along each of the wires of said second group of wires electrically connected by said first short circuiting member between said first short circuiting member and said connector.

18. The wire harness of claim 17, wherein each said short circuiting member includes a pair of terminal portions for penetrating the insulating coating of the respective electrical wires and a coupling portion electrically connecting said terminal portions.

* * * * *